US007609244B2

(12) United States Patent
Kim et al.

(10) Patent No.: US 7,609,244 B2
(45) **Date of Patent: *Oct. 27, 2009**

(54) APPARATUS AND METHOD OF DRIVING LIQUID CRYSTAL DISPLAY DEVICE

(75) Inventors: Seong Gyun Kim, Gunpo-si (KR); Min Ho Sohn, Anyang-si (KR)

(73) Assignee: LG. Display Co., Ltd., Seoul (KR)

( * ) Notice: Subject to any disclaimer, the term of this patent is extended or adjusted under 35 U.S.C. 154(b) by 504 days.

This patent is subject to a terminal disclaimer.

(21) Appl. No.: 11/415,747

(22) Filed: May 2, 2006

(65) Prior Publication Data

US 2007/0001997 A1 Jan. 4, 2007

(30) Foreign Application Priority Data

Jun. 30, 2005 (KR) ..... 10-2005-0058622
Dec. 26, 2005 (KR) ..... 10-2005-0129632

(51) Int. Cl.
*G09G 3/36* (2006.01)

(52) U.S. Cl. ..... 345/89; 345/102

(58) Field of Classification Search ..... 345/102, 345/87–89, 98–100, 600–604; 348/671–672
See application file for complete search history.

(56) References Cited

U.S. PATENT DOCUMENTS 6,850,214 B2 * 2/2005 Nishitani et al. ..... 345/87
7,289,100 B2 * 10/2007 Sohn et al. ..... 345/102
7,352,352 B2 * 4/2008 Oh et al. ..... 345/102
7,375,719 B2 * 5/2008 Oh et al. ..... 345/102
7,394,448 B2 * 7/2008 Park et al. ..... 345/102
7,443,377 B2 * 10/2008 Kim ..... 345/102
2001/0033260 A1 * 10/2001 Nishitani et al. ..... 345/87
2004/0257329 A1 * 12/2004 Park et al. ..... 345/102
2005/0104837 A1 * 5/2005 Baik et al. ..... 345/99
2005/0104839 A1 * 5/2005 Baik ..... 345/102
2005/0104840 A1 * 5/2005 Sohn et al. ..... 345/102
2005/0104841 A1 * 5/2005 Sohn et al. ..... 345/102
2005/0117799 A1 * 6/2005 Fuh et al. ..... 382/169
2005/0140616 A1 * 6/2005 Sohn et al. ..... 345/87
2005/0140639 A1 * 6/2005 Oh et al. ..... 345/102
2005/0219179 A1 * 10/2005 Kim ..... 345/89
2006/0050084 A1 * 3/2006 Jeffrey et al. ..... 345/617
2006/0274937 A1 * 12/2006 Jeffrey et al. ..... 382/169
2007/0001997 A1 * 1/2007 Kim et al. ..... 345/102
2008/0224977 A1 * 9/2008 Park et al. ..... 345/89

* cited by examiner

*Primary Examiner*—Ricardo L Osorio
(74) *Attorney, Agent, or Firm*—Brinks Hofer Gilson & Lione

(57) ABSTRACT

A driving apparatus and method of an LCD device improves the brightness and the contrast ratio of an image. The driving apparatus includes an LCD panel for displaying an image corresponding to a data signal. A data driver supplies the data signal to the LCD panel. A gate driver supplies a scan signal to the LCD panel. A picture quality improving unit generates a histogram by dividing brightness components of input data into levels, generates data with an extended contrast ratio, and then generates a brightness control signal according to the average value of the histogram. A timing controller supplies reordered data, and controls the data driver and the gate driver. A backlight provides light to the LCD panel. An inverter drives the backlight based on the brightness control signal.

66 Claims, 25 Drawing Sheets

APPARATUS AND METHOD OF DRIVING LIQUID CRYSTAL DISPLAY DEVICE

This application claims the benefit of the Korean Patent Application Nos. P2005-58622 filed on Jun. 30, 2005, and P2005-129632 filed Dec. 26, 2005, which are hereby incorporated by reference as if fully set forth herein.

BACKGROUND

1. Technical Field

The technical field relates to a liquid crystal display (LCD) device, and more particularly, to a driving apparatus and method of an LCD device to improve brightness and contrast ratio of image.

2. Discussion of the Related Art

An LCD device displays images by controlling light transmittance of liquid crystal cells according to video signals. The LCD device may be formed in an active matrix type which may include switching devices in the liquid crystal cells. The LCD device may be used for monitors of a computer, office equipment, a cellular phone, and other electronic devices. The switching devices used for the LCD device of the active matrix type may be formed of thin film transistors (hereinafter, referred to as "TFTs").

FIG. 1 is a block diagram of a driving apparatus of an LCD device according to the related art. Referring to FIG. 1, the driving apparatus of the LCD device according to the related art may include an LCD panel 2, a data driver 4, a gate driver 6, a gamma voltage supplier 8, a timing controller 10, a DC/DC converter 14, and an inverter 16.

In the LCD panel 2, 'm×n' liquid crystal cells (where m and n are natural numbers) (Clc) are arranged in a matrix type, and a plurality of TFTs may be formed adjacent to crossings of gate and data lines. Also, the data driver 4 supplies a data signal to the data lines (DL1 to DLm), and the gate driver 6 supplies a scan signal to the gate lines (GL1 to GLn). Also, the gamma voltage supplier 8 supplies a gamma voltage to the data driver 4. The timing controller 10 controls the data driver 4 and the gate driver 6 with synchronization signals provided from a system 20. Also, the DC/DC converter 14 generates voltages for the LCD panel 2 with voltages provided from a power supplier 12. The inverter 16 drives a backlight 18.

The system 20 supplies horizontally and vertically synchronized signals (Hsync and Vsync), a clock signal (DCLK), a data enable signal (DE), and data (R, G, B signal components) to the timing controller 10. The LCD panel 2 may include the plurality of liquid crystal cells (Clc) arranged in the matrix type and formed adjacent to the crossings of the gate lines (GL1 to GLn) and the data lines (DL1 to DLm). The plurality of TFTs formed in the respective liquid crystal cells (Clc) respond to the scan signal provided from the gate lines (GL), and supply the data signal provided from the data lines (DL) to the liquid crystal cells (Clc). Also, a storage capacitor (Cst) may be formed in each of the liquid crystal cells (Clc). The storage capacitor (Cst) may be formed between the preceding gate line and a pixel electrode of the liquid crystal cell (Clc), or may be formed between a common electrode line and the pixel electrode of the liquid crystal cell (Clc), to maintain a constant voltage in the liquid crystal cell (Clc).

The gamma voltage supplier 8 supplies a plurality of the gamma voltages to the data driver 4. The data driver 4 responds to a control signal (CS) provided from the timing controller 10, converts data (R,G, B signal components) to an analog gamma voltage (data signal) corresponding to a gray scale value, and supplies the analog gamma voltage to the data lines (DL1 to DLm). Also, the gate driver 6 responds to the control signal (CS) provided from the timing controller 10, sequentially supplies the scan signal to the gate lines (GL1 to GLn), and selects a horizontal line of the LCD panel 2 to which the data signal is supplied.

The timing controller 10 generates the control signals (CS) for controlling the gate driver 6 and the data driver 4 using the horizontally and vertically synchronized signals (Hsync and Vsync), and the clock signal (DCLK). At this time, the control signal (CS) for controlling the gate driver 6 may include a gate start-pulse (GSP), a gate shift clock (GSC), and a gate output enable (GOE). Also, the control signal (CS) for controlling the data driver 4 may include a source start pulse (SSP), a source shift clock (SSC), a source output enable (SOE), and a polarity signal (POL). The timing controller 10 re-arranges the data (R, G, B) provided from the system 20, and then supplies the re-arranged data (R, G, B) to the data driver 4.

The DC/DC converter 14 generates the voltage provided to the LCD panel 2 by increasing or decreasing a 3.3V provided from the power supplier 12. The DC/DC converter 14 generates a gamma reference voltage, a gate high voltage (VGH), a gate low voltage (VGL), and a common voltage (Vcom). Also, the inverter 16 supplies a lamp driving voltage for driving the backlight 18 to the LCD panel 2. The backlight 18 generates the light corresponding to the lamp driving voltage supplied from the inverter 16, and supplies the generated light to the LCD panel 2.

To obtain vivid images by improving picture quality of the images displayed in the above LCD panel 2, it is necessary to improve the contrast ratio between dark and bright images. In the case of the related art LCD device, there is no way to improve the contrast ratio in accordance with the data. Also, the backlight 18 of the related art LCD device emits light of a constant level regardless of the data, so that it is difficult to obtain the vivid images. For example, when displaying the scene of explosion, there is requirement for emphasizing the brightness in the exploding portion. However, the related art LCD device may include a backlight 18 emitting light of a constant level, whereby the related art LCD device has no vivid images. Therefore, a need exists for improvements to contrast level displays in LCD devices.

SUMMARY OF THE INVENTION

The disclosure is directed to a driving apparatus and method of an LCD device.

A driving apparatus and method of an LCD device is disclosed to improve the brightness and contrast ratio of image.

Additional advantages and features of the disclosure will be set forth in part in the description which follows and in part will become apparent to those having ordinary skill in the art upon examination of the following or may be learned from practice of the disclosure.

A driving apparatus of an LCD device includes an LCD panel for displaying an image corresponding to a data signal. A data driver supplies the data signal to the LCD panel. A gate driver supplies a scan signal to the LCD panel. A picture quality improving unit generates a histogram by dividing brightness components of input first data into levels, generates data having an extended contrast ratio, and generates a brightness control signal based on the average value of the histogram. A timing controller supplies rearranged data, and controls the data driver and the gate driver. A backlight provides a light to the LCD panel, and an inverter drives the backlight based on the brightness control signal.

A driving method is disclosed for an LCD device having an LCD panel for displaying an image corresponding to a data signal, a data driver for supplying the data signal to the LCD panel, and a gate driver for supplying a scan signal to the LCD panel. The method may include generating a histogram by dividing brightness components of input first data by levels. The method may generate second data having an extended contrast ratio based on the brightness of the histogram by levels using an average value of the histogram. The method may rearrange the second data, and supply the rearranged second data to the data driver.

It is to be understood that both the foregoing general description and the following detailed description of the disclosure are explanatory and are intended to provide further explanation of the LCD device and method as claimed.

BRIEF DESCRIPTION OF THE DRAWINGS

The accompanying drawings, which are included to provide a further understanding of the disclosure and are incorporated in and constitute a part of this disclosure, illustrate example systems of the disclosure and together with the description serve to explain the LCD device and method. In the drawings.

DETAILED DESCRIPTION OF THE INVENTION

Reference will now be made in detail to the disclosure, examples of which are illustrated in the accompanying drawings. Wherever possible, the same reference numbers will be used throughout the drawings to refer to the same or like parts.

Figure 1:
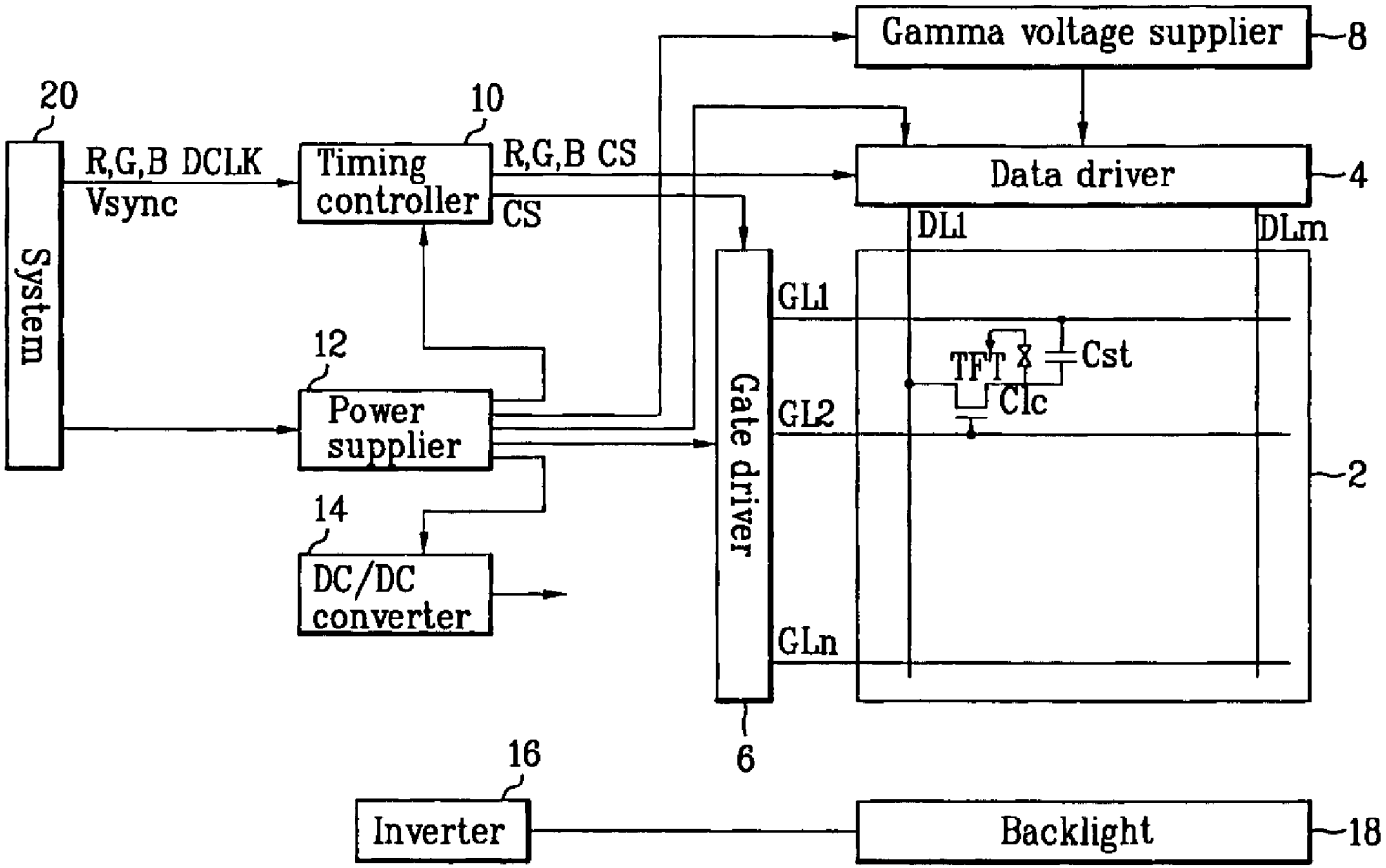
FIG. 1 Related Art
FIG. 1 is a block diagram of a driving apparatus of an LCD device according to the related art.
Figure 2:
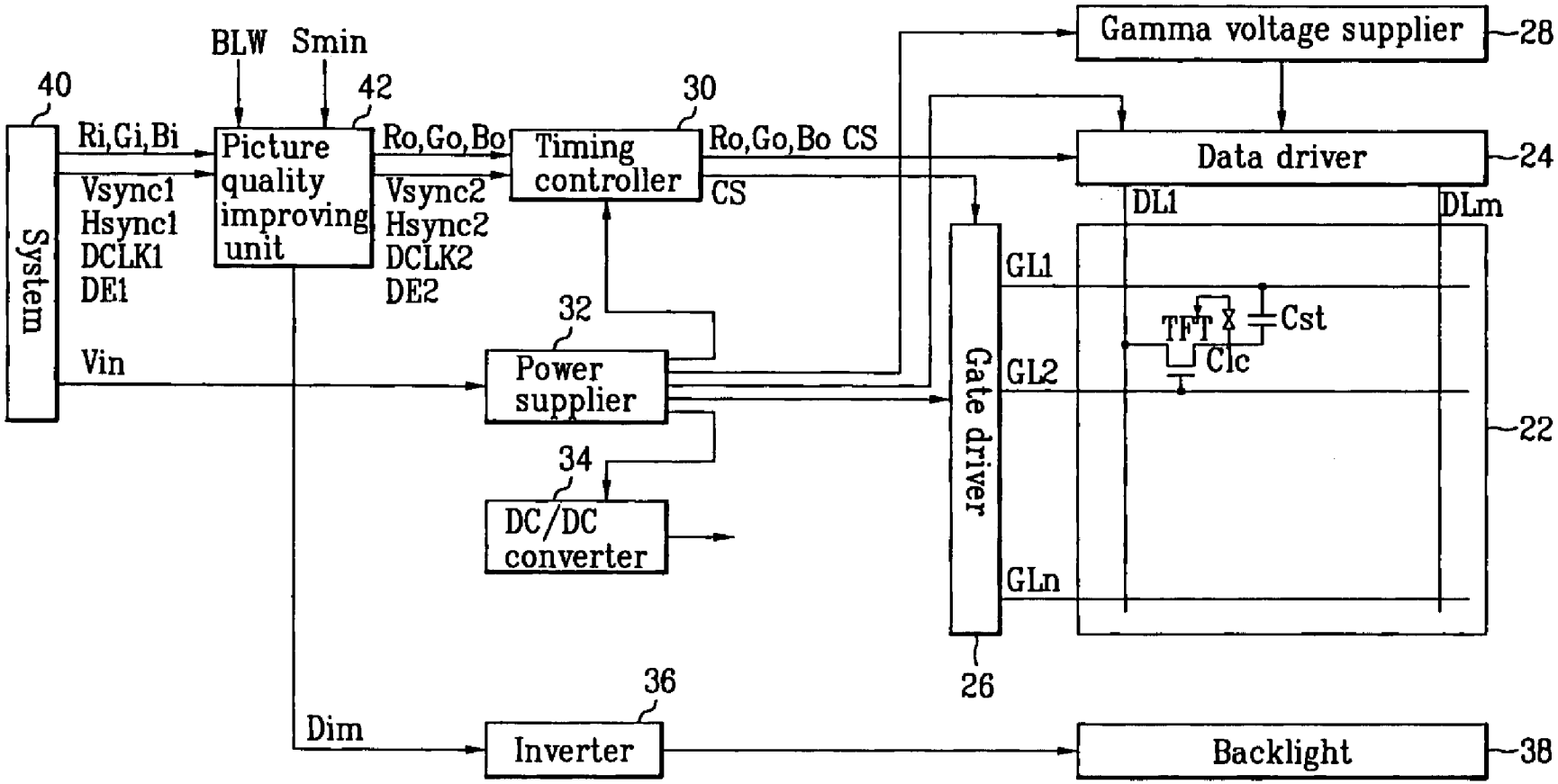
FIG. 2 is a block diagram of a driving apparatus of an LCD device.

FIG. 2 is a block diagram of a driving apparatus of an LCD device. As shown in FIG. 2, the driving apparatus of the LCD device includes an LCD panel 22, a data driver 24, a gate driver 26, a picture quality improving unit 42, a timing controller 30, a backlight 38, and an inverter 36.

The LCD panel 22 may include a plurality of thin film transistors TFTs formed adjacent to crossings of n-th gate lines (GL1 to GLn) and m-th data lines (DL1 to Dlm) (where m and n are natural numbers). The data driver 24 supplies a data signal to the data lines (DL1 to DLm), and the gate driver 26 supplies a scan signal to the gate lines (GL1 to GLn). The picture quality improving unit 42 may generate a histogram by dividing brightness components of input first data (Ri, Gi and Bi signal components) into a plurality of levels. The picture quality improving unit 42 may generate second data (Ro, Go and Bo signal components) having an extended contrast ratio based on the brightness of the histogram by levels using a calculated value of the histogram, such as an average value, median, mode, skew, kurtosis, or other numerical or statistical characteristic of the histogram. The picture quality improving unit 42 may generate a brightness control signal (Dim) based on the calculated value of the histogram. The timing controller 30 may re-arrange the second data (Ro, Go and Bo) to be suitable for driving the LCD panel 22, supply the arranged second data to the data driver 24, and control the data driver 24 and the gate driver 26. The backlight 38 emits light to the LCD panel 22, and the inverter 36 drives the backlight 38 depending on the brightness control signal (Dim).

The driving apparatus of the LCD device may include a system 40, such as an external source, a gamma voltage supplier 28, a power supplier 32, and a DC/DC converter 34. The system 40 may generate the first data (Ri, Gi and Bi), first horizontally and vertically synchronized signals (Hsync1 and Vsync1), a first clock signal (DCLK1), a first data enable signal (DE1), and a driving power (Vin). The gamma voltage supplier 28 may generate a plurality of reference gamma voltages of different values, and supply the generated reference gamma voltages to the data driver 24. The power supplier 32 may generate driving voltages for the timing controller 30, the gamma voltage supplier 28, the data driver 24, and the gate driver 26 by using the driving power (Vin). The DC/DC converter 34 may generate voltages supplied to the LCD panel 22 by using the voltage supplied from the power supplier 32.

The system 40 supplies the first horizontally and vertically synchronized signals (Hsync1 and Vsync1), the first clock signal (DCLK1), the first data enable signal (DE1), and the first data (Ri, Gi and Bi) to the picture quality improving unit 42. The system 40 supplies the driving power (Vin) input from the external to the power supplier 32. The DC/DC converter 34 generates the voltage supplied to the LCD panel 22 by increasing or decreasing a 3.3V input from the power supplier 32. The DC/DC converter 34 generates the gamma reference voltage, a gate high voltage (VGH), a gate low voltage (VGL), and a common voltage (Vcom).

The LCD panel 22 may include a plurality of liquid crystal cells (Clc) arranged in a matrix type and formed adjacent to the crossings of the gate lines (GL1 to GLn) and the data lines (DL1 to DLm) (where m and n are natural numbers). The plurality of TFTs formed in the respective liquid crystal cells (Clc) may respond to the scan signal provided from the gate lines (GL), and supply the data signal provided from the data lines (DL) to the liquid crystal cells (Clc). A storage capacitor (Cst) may be formed in each of the liquid crystal cells (Clc). The storage capacitor (Cst) may be formed between the preceding gate line and a pixel electrode of the liquid crystal cell (Clc), or may be formed between a common electrode line and the pixel electrode of the liquid crystal cell (Clc), to maintain a constant voltage in the liquid crystal cell (Clc).

The gamma voltage supplier 28 generates the reference gamma voltages having different values using the driving voltage provided from the power supplier 32, and supplies the generated reference gamma voltages to the data driver 24.

The picture quality improving unit 42 generates the histogram by dividing the brightness components of inputted first data (Ri, Gi and Bi) into levels according to the first horizontally and vertically synchronized signals (Hsync1 and Vsync1), the first clock signal (DCLK1), and the first data enable signal (DE1) Also, the picture quality improving unit 42 generates the second data (Ro, Go and Bo) having the extended contrast ratio based on the brightness of the histogram by levels using the calculated value of the histogram, such as the average value, and supplies the generated second data (Ro, Go and Bo) to the timing controller 30. The picture quality improving unit 42 generates the brightness control signal (Dim) based on the calculated value of the histogram, and supplies the generated brightness control signal (Dim) to the inverter 36. The picture quality improving unit 42 generates second horizontally and vertically synchronized signals (Hsync2 and Vsync2), a second clock signal (DCLK2), and a second data enable signal (DE2) in synchronization with the second data (Ro, Go and Bo), and supplies the second horizontally and vertically synchronized signals (Hsync2 and Vsync2), the second clock signal (DCLK2), and the second data enable signal (DE2) to the timing controller 30.

The timing controller 30 may generate the control signals (CS) for controlling the gate driver 26 and the data driver 24 by using second horizontally and vertically synchronized signals (Hsync2 and Vsync2) and the second clock signal (DCLK2) input from the picture quality improving unit 42. The timing controller 30 arranges the second data (Ro, Go and Bo) to be suitable for driving the LCD panel 22, and supplies the arranged second data to the data driver 24. The control signal (CS) for controlling the gate driver 26 may include a gate start pulse (GSP), a gate shift clock (GSC), and a gate output enable (GOE). Also, the control signal (CS) for controlling the data driver 24 may include a source start pulse (SSP), a source shift clock (SSC), a source output enable (SOE), and a polarity signal (POL).

The data driver 24 responds to the control signal (CS) supplied from the timing controller 30, selects any one as the data signal from the plurality of gamma voltages according to the gray scale value of the second data (Ro, Go and Bo) supplied from the timing controller 30, and supplies the selected data signal to the data lines (DL1 to DLm). The gate driver 26 responds to the control signal (CS) supplied from the timing controller 30, and selects the horizontal line of the LCD panel 22 having the data signal supplied thereto by supplying the scan signal to the gate lines (GL1 to GLn). The gate driver 26 may sequentially supply the scan signal to the gate lines.

The inverter 36 controls the lamp driving power (or AC waveform) according to the brightness control signal (Dim) supplied from the picture quality improving unit 42, and supplies the lamp driving power to the backlight 38. The backlight 38 may generate the light based on the lamp driving power supplied from the inverter 36, and emit the generated light to the rear surface of the LCD panel 22. The backlight 38 may be formed in an edge type or a direct type. For the edge type backlight unit, a light source is positioned at a lateral side of a light guiding plate for guiding the light to the LCD panel 22, and the light is emitted to the LCD panel 22 through the light guiding plate. For the direct type backlight unit, a plurality of light sources are positioned at the rear surface of the LCD panel 22, whereby the LCD panel 22 is directly illuminated with the light generated from the plurality of light sources.

Figure 3:
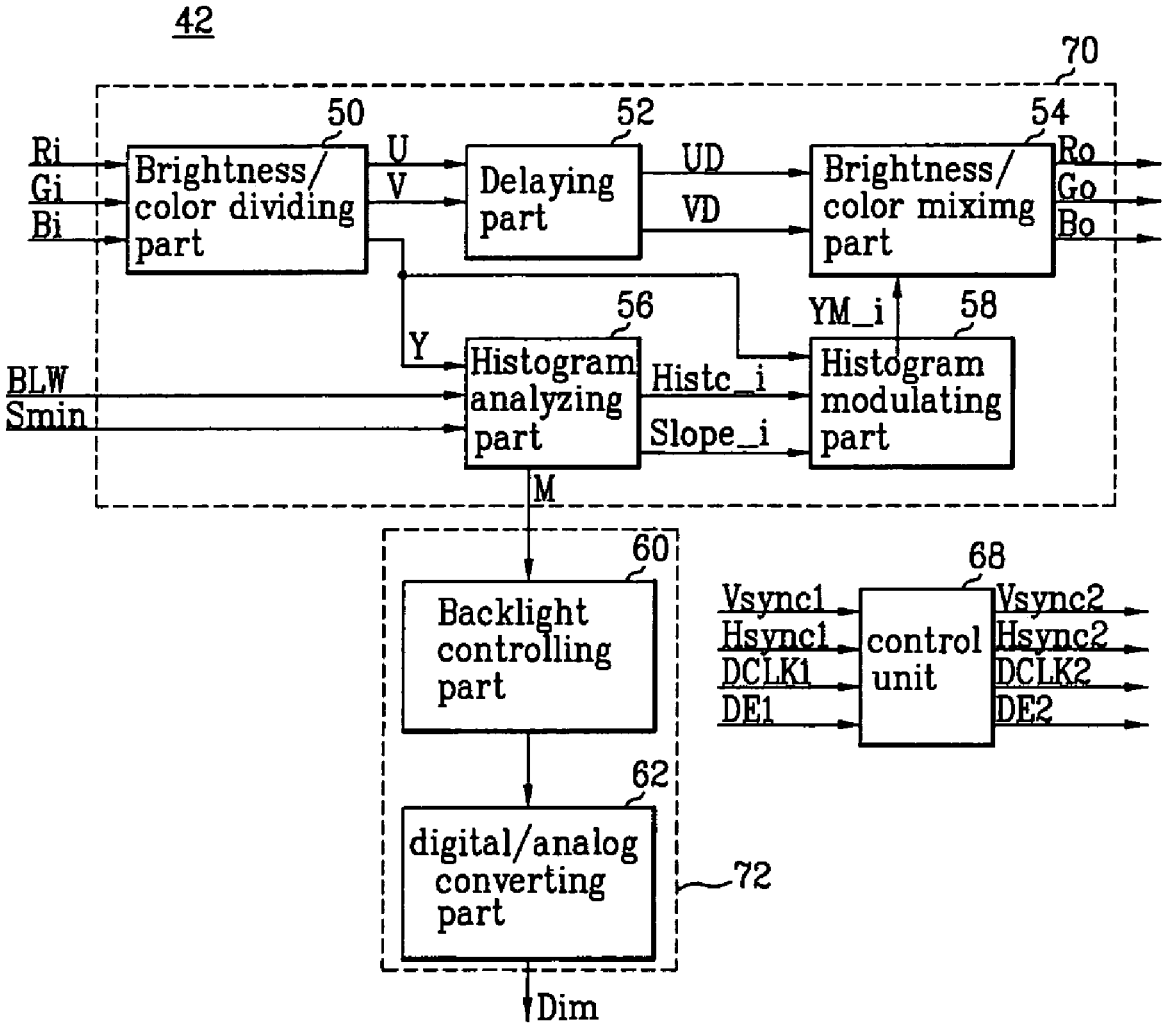
FIG. 3 is a block diagram of a picture quality improving unit.

FIG. 3 is a block diagram of the picture quality improving unit 42 shown in FIG. 2. As shown in FIG. 3, the picture quality improving unit 42 may include a data modulation module 70, a backlight controller 72, and a control unit 68. The data modulation module 70 generates the histogram by dividing the brightness components of inputted first data (Ri, Gi and Bi) into levels based on the first horizontally and vertically synchronized signals (Hsync1 and Vsync1), the first clock signal (DCLK1), and the first data enable signal (DE1) provided from the system 40. The data modulation module 70 may generate the second data (Ro, Go and Bo) having the extended contrast ratio based on the brightness of the histogram by levels using the calculated value of the histogram, such as the average value of the histogram, and may supply the second data to the timing controller 30. The backlight controller 72 generates the brightness control signal (Dim) based on the calculated value (M) of the histogram. The control unit 68 generates the second horizontally and vertically synchronized signals (Hsync2 and Vsync2), the second clock signal (DCLK2), and the second data enable (DE2) in synchronization with the second data (Ro, Go and Bo).

The data modulation module 70 may include a brightness/color dividing part 50, a delaying part 52, a brightness/color mixing part 54, a histogram analyzing part 56, and a histogram modulating part 58. The brightness/color dividing part 50 divides the first data (Ri, Gi and Bi) by brightness components (Y) and color-difference components (U and V). The brightness components (Y) and the color-difference components (U and V) may be expressed by the following equations 1 to 3.

$$Y=0.229\times Ri+0.587\times Gi+0.114\times Bi \quad \text{[equation 1]}$$

$$U=0.493\times(Bi-Y) \quad \text{[equation 2]}$$

$$V=0.887\times(Ri-Y) \quad \text{[equation 3]}$$

The brightness/color dividing part 50 supplies the brightness components (Y) derived from the first data (Ri, Gi and Bi) to the histogram analyzing part 56, and supplies the color-difference components (U and V) divided from the first data (Ri, Gi and Bi) to the delaying unit 52.

The histogram analyzing part 56 may extract the histogram by dividing the brightness component (Y) of the unit frame supplied from the brightness/color dividing part 50 into at least 16 levels, generate the calculated value, such as the average value and set the slope by levels with reference to the generated average value. The histogram analyzing part 56 may set each slope by levels as well.

Figure 4:
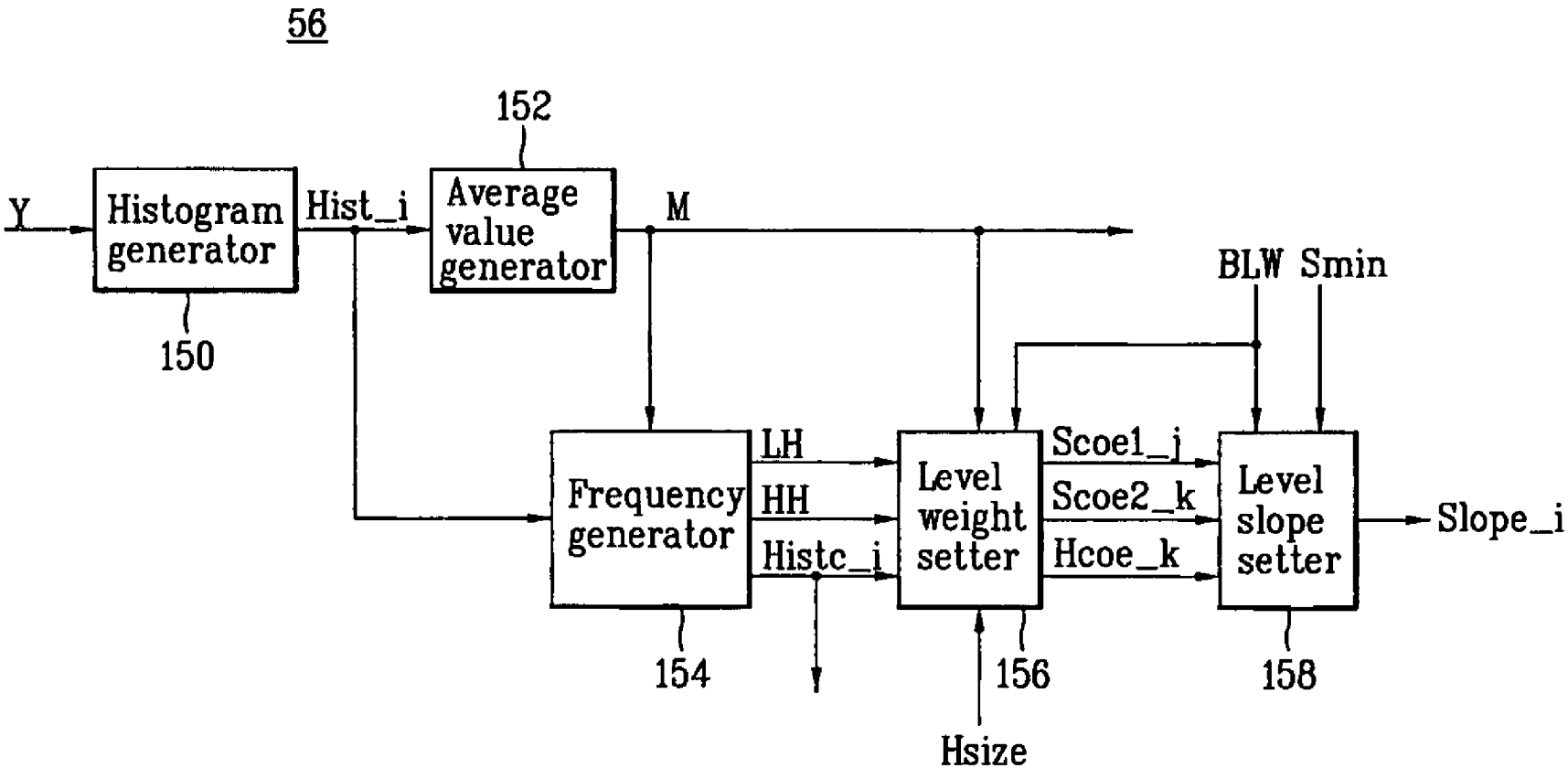
FIG. 4 is a block diagram of a histogram analyzing part.

FIG. 4 is a block diagram of the histogram analyzing part 56. As shown in FIG. 4, the histogram analyzing part 56 may include a histogram generator 150, an average value generator 152, a frequency generator 154, a level weight setter 156, and a level slope setter 158.

Figure 5:
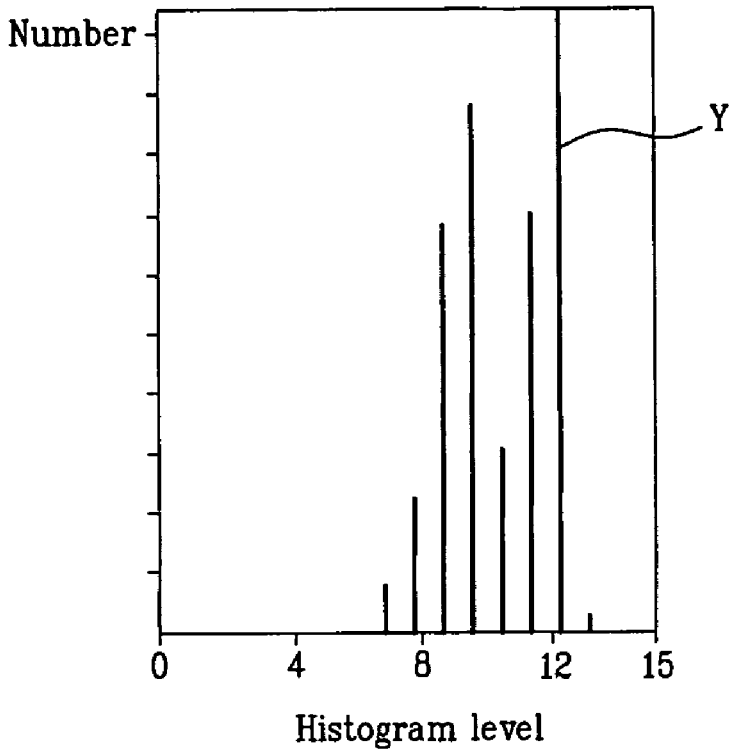
FIG. 5 is a histogram by levels generated in a histogram generator.

The histogram generator 150 arranges the brightness components (Y) provided from the brightness/color dividing part 50 by at least 16 levels, and generates the histogram (Hist_i, 'i' is from 1 to 16) of unit frame shown in FIG. 5. The histogram generator 150 cumulates the brightness components (Y) by levels, to generate the histogram (Hist_i) by levels. The histogram generator 150 reads the brightness information of the first data (Ri, Gi and Bi). In the histogram of FIG. 5, for example, if the histogram (Hist_i) is concentrated to the right side (high level), it may represent a bright image. If the histogram (Hist_i) is concentrated to the left side (low level), it may represent a dark image.

The histogram generator 150 may generate the histogram (Hist_i) by dividing the brightness components (Y) supplied from the brightness/color dividing part 50 into 8 levels or 32 levels. If the histogram generator 150 generates a histogram (Hist_i) by dividing the brightness components (Y) corresponding to the first data (Ri, Gi and Bi) of 8 bits into 16 levels, the histogram generator 150 generates the histogram (Hist_i) of 16 levels by cumulating the brightness components (Y) in 16 gray scale units, that is, 256/16.

The average value generator 152 multiplies the respective histogram levels by the histogram (Hist_i), adds the multiplied results, and then divides the added total value by the total histogram number, to thereby generate the average value (M), that is, $$\frac{\sum_{p=1}^{i}(p \times \text{Hist_p})}{\sum_{p=1}^{i}\text{Hist_p}}.$$

According to the histogram (Hist_i) by level with reference to the average value (M), the frequency generator 154 generates a cumulated histogram number (LH) of a first region which is smaller than the average value (M), generates a cumulated histogram number (HH) of a second region which is larger than the average value (M), and generates a cumulated histogram number (Histc_i) for the levels, such as for each level.

The level weight setter 156 may set weights (Scoe1_j and Scoe2_k) of the first region and the second region by levels, and may set a brightness weight (Hcoe_k) of the second region by levels, as expressed in the following equations 4 and 5, using the average value (M), the cumulated histogram number (LH) of the first region, the cumulated histogram number (HH) of the second region, the histogram number (Histc_i) for the levels, the adjacent histogram level (Hsize), and a backlight weight (BLW). The backlight weight (BLW) may be set as a constant, such as between 1 and 2, to compensate for the ratio between the minimum brightness and the maximum brightness.

$$Scoe1_j=(M-1)\times(Histc_i/LH) \quad \text{[equation 4]}$$

$$Scoe2_k=(Hsize-M)\times(Histc_i/HH)$$

$$Hcoe_k=(Hsize-BLW\times M)/(Hsize-M) \quad \text{[equation 5]}$$

In the above equations 4 and 5, 'j' corresponds to the first to M levels, and 'k' corresponds to the M to 'i' levels, wherein M level corresponds to the average value (M) of the histogram.

The level slope setter 158 may set a slope (Slope_i) for the levels of the histogram, using a minimum slope value (Smin) set from the external source, the backlight weight (BLW), the brightness weight (Hcoe_k) of the second region by levels, and the weights (Scoe1_j and Scoe2_K) of the first and second regions by levels. The minimum slope value (Smin) may be set as a constant, such as between 0 and 1, to prevent the distortion of original image caused by the extreme emphasis of the contrast ratio in the histogram level.

The level slope setter 158 may set the histogram slope (Slope_1 to Slope_M) for the levels of the first region which are smaller than the average value (M), using the minimum slope value (Smin), the backlight weight (BLW), and the weight (Scoe1_j) of the first region by levels, as expressed in the following equation 6.

$$Slope_j=BLW\times(Scoe1_j\times(1-Smin)+Smin) \quad \text{[equation 6]}$$

The level slope setter 158 sets the slope (Slope_M) of histogram level based on the average value (M) according to the backlight weight (BLW), as expressed in the following equation 7.

$$Slope_M=BLW \quad \text{[equation 7]}$$

The level slope setter 158 sets the histogram slope (Slope_M+1 to Slope_i) for the levels of the second region which are larger than the average value (M), using the minimum slope value (Smin), the weight (Scoe2_k) of the second region by levels, and the brightness weight (Hcoe_k) of the second region by levels.

$$Slope_k=Hcoe_k\times(Scoe2_k\times(1-Smin)+Smin) \quad \text{[equation 8]}$$

The level slope setter 158 sets the slopes (Slope_1 to Slope_16) of histogram from 1 to 'i' levels, for example, from 1 to 16 levels, and then supplies the slopes to the histogram modulating part 58.

The histogram analyzing part 56 may supply the average value (M) generated from the average value generator 152 to the backlight control module 72. The histogram analyzing part 56 generates the average value (M) by extracting the histogram (Hist_i) of 16 levels from the brightness components (Y) of one frame. Then, the histogram analyzing part 56 sets the slope (Slope_1 to Slope_16) for each level of the histogram based on the average value (M), and supplies the slope to the histogram modulating part 58.

Figure 6:
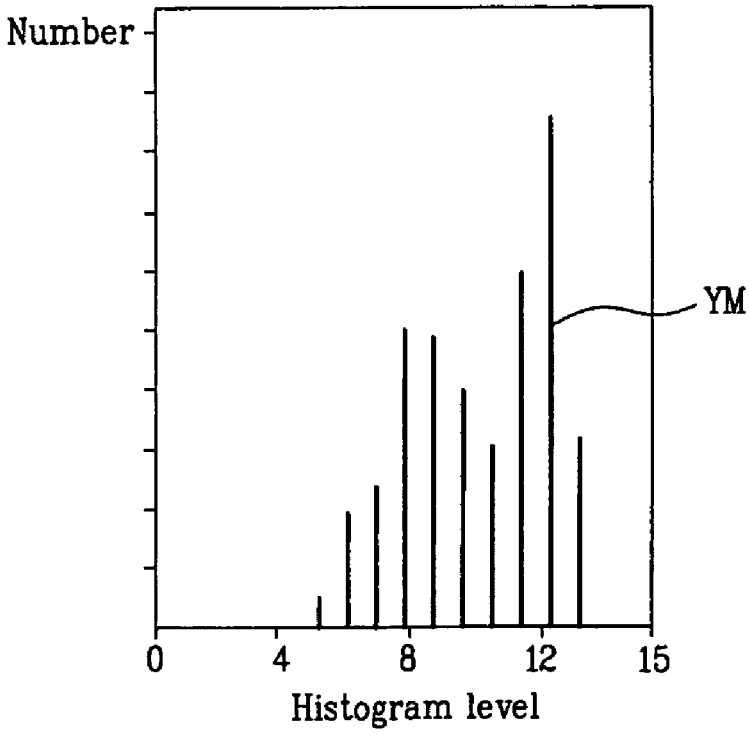
FIG. 6 is a modulated histogram by levels.

The histogram modulating part 58 generates the modulated brightness components (YM_i) for the levels, as shown in FIG. 6, by modulating the brightness components (Y) supplied from the brightness/color dividing part 50 of FIG. 5 to extend the contrast ratio. The histogram modulating part 58 uses the slope (Slope_1 to Slope_16) for the levels of the histogram, the present histogram level (X_i), the previous histogram level (Xoffset), and the histogram number of the previous level (Yoffset), as expressed in the following equation 9.

$$YM_i=Slope_i\times(X_i-Xoffset)+Yoffset \quad \text{[equation 9]}$$

Figure 7:
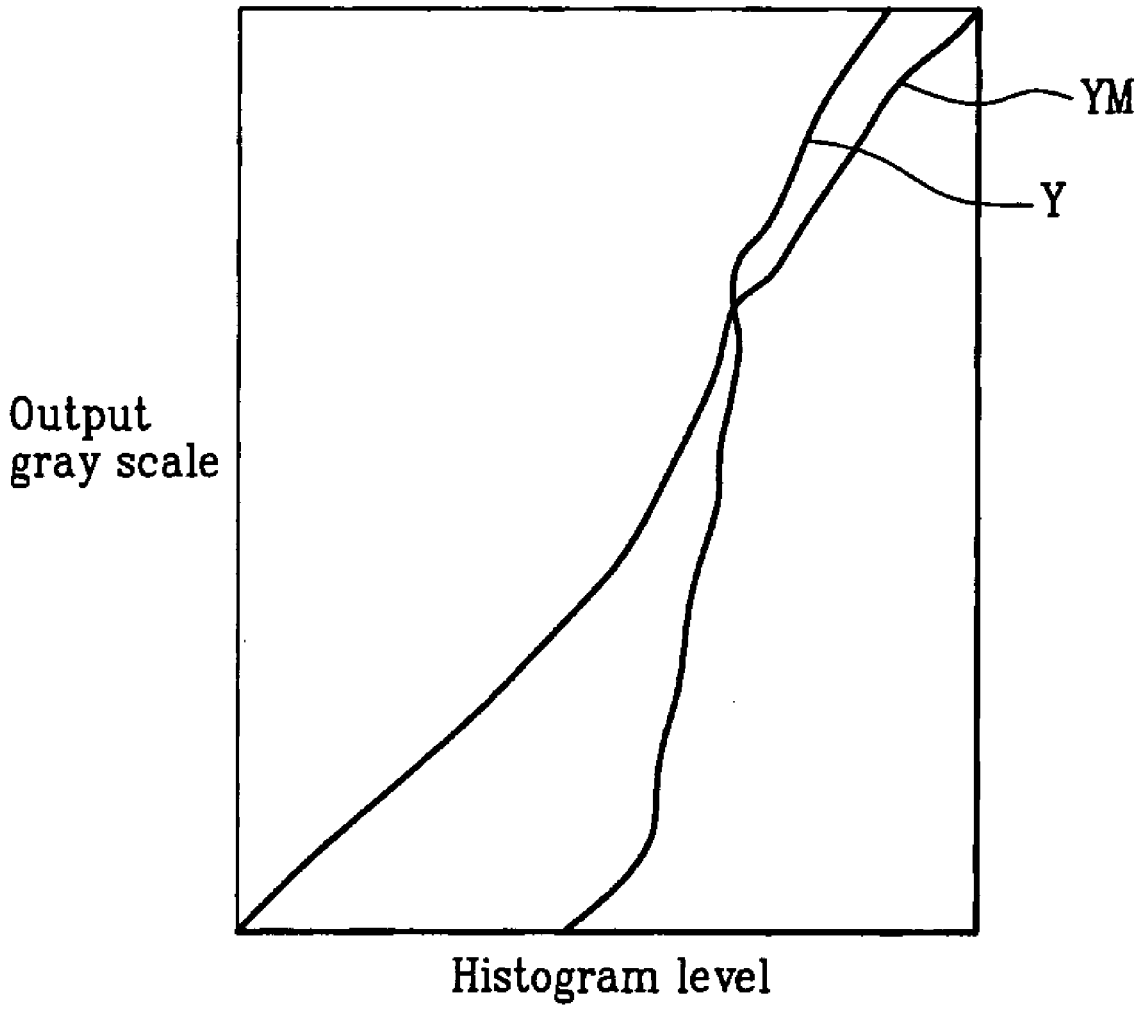
FIG. 7 is a graph of modulated brightness components.

The histogram modulating part 58 may include a register for supplying the present histogram level (X_i), the previous histogram level (Xoffset), and the histogram number (Yoffset) of the previous level by temporarily storing the histogram number (Histc_i) for each level supplied from the frequency generator 154 of the histogram analyzing part 56. The histogram modulating part 58 subtracts the previous histogram level (Xoffset) from the present histogram level (X_i) supplied from the register, multiplies the result by the slope (Slope_i) corresponding to the present histogram level (X_i), and then adds the result to the histogram number (Yoffset) of the previous level, in sequence, thereby generating the modulated brightness component (YM_i) for each level. As shown in FIG. 7, the gray scale of the modulated brightness component (YM) may be distributed in all regions, so that it may be possible to improve the contrast ratio between the dark and bright images.

The delaying part 52 delays the color-difference components (U and V) when the brightness component (Y) is analyzed in the histogram analyzing part 56 and the histogram modulating part 58, to generate delayed color-difference components (UD and VD). The delaying part 52 is synchronized with the modulated brightness component (YM), and the delaying part 52 supplies the delayed color-difference components (UD and VD) to the brightness/color mixing part 54. The brightness/color mixing part 54 generates the second data (Ro, Go and Bo) using the modulated brightness component (YM) and the delayed color-difference components (UD and VD). The second data (Ro, Go and Bo) are obtained by the following equations 10 to 12.

$$Ro=YM+0.000\times UD+1.140\times VD \quad \text{[equation 10]}$$

$$Go=YM-0.396\times UD-0.581\times VD \quad \text{[equation 11]}$$

$$Bo=YM+2.029\times UD+0.000\times VD \quad \text{[equation 12]}$$

The data modulation module 70 operation will be described as follows.

The brightness/color dividing part 50 divides the first data (Ri, Gi and Bi) by the brightness component (Y) and the color-difference components (U and V) using the equations 1 to 3. The brightness component (Y) may be input to the histogram analyzing part 56, and the color-difference components (U and V) may be input to the delaying part 52.

The histogram analyzing part 56 extracts the histogram (Hist_i) by dividing the brightness component (Y) of the unit frame supplied from the brightness/color dividing part 50 into at least 16 levels. The histogram analyzing part 56 generates the average value (M), and sets the slope (Slope_1 to Slope_16) for the levels with reference to the generated average value (M). The histogram analyzing part 56 supplies the slope (Slope_1 to Slope_16) for each level to the histogram modulating part 58, and supplies the generated average value (M) to the backlight control module 72.

The histogram modulating part 58 extends the brightness component (Y) so the brightness component (Y) is distributed over the entire gray scale region according to the slope (Slope_1 to Slope_16) for each level from 1 to 16 using the equation 9. The histogram modulating part 58 thereby generates the modulated brightness component (YM). The histogram modulating part 58 supplies the modulated brightness component (YM) to the brightness/color mixing part 54.

By using the equations 10 to 12, the brightness/color mixing part 54 generates the second data (Ro, Go and Bo) based on the delayed color-difference components (UD and VD) and the modulated brightness component (YM). The second data (Ro, Go and Bo) may have a clearer contrast since the second data (Ro, Go and Bo) is generated by the modulated brightness component (YM). The brightness component (YM) may be distributed over substantially the entire gray scale region to generate the second data (Ro, Go and BO) having a clearer brightness and darkness, whereby vivid picture images can be displayed in the LCD panel 22. Bright colors may become brighter and dark colors may become darker, and thus the contrast may be improved.

Meanwhile, the backlight control module 72 generates the brightness control signal (Dim) related to the average value (M) supplied from the histogram analyzing part 56, and supplies the generated brightness control signal (Dim) to the inverter 36. The backlight control module 72 comprises a backlight controlling part 60, and a digital/analog converting part 62.

The backlight controlling part 60 generates the brightness control signal (Dim) that relates to the average value (M) supplied from the histogram analyzing part 56. If the average value (M) has a value representing the highest brightness, the backlight controlling part 60 generates the brightness control signal (Dim) to produce the light of highest brightness. However, if the average value (M) has a value representing the lowest brightness, the backlight controlling part 60 generates the brightness control signal (Dim) to produce the light of lowest brightness. The digital/analog converting part 62 may convert the brightness control signal (Dim) to an analog control signal, and supply the analog control signal to the inverter 36.

The inverter 36 supplies the lamp driving power based on the brightness control signal (Dim) to the backlight 38. The backlight 38 generates a light of a brightness corresponding to the lamp driving power supplied from the inverter 36, and the generated light is supplied to the LCD panel 22. The backlight controlling part 60 controls the light from the backlight 38 based on the average value (M) from the histogram analyzing part 56. The bright colors may be displayed more brightly and the dark colors may be displayed more darkly in the LCD panel 22. This may permit picture images with higher contrast to be displayed in the LCD panel 22.

The control unit 68 receives the first vertically and horizontally synchronized signals (Vsync1 and Hsync1), the first clock signal (DCLK1), and the first data enable signal (DE1) from the system 40. Also, the control unit 68 generates the second vertically and horizontally synchronized signals (Vsync2 and Hsync2), the second clock signal (DCLK2), and the second data enable signal (DE2) in synchronization with the second data (Ro, Go and Bo), and supplies the second vertically and horizontally synchronized signals (Vsync2 and Hsync2), the second clock signal (DCLK2), and the second data enable signal (DE2) to the timing controller 30.

In the above driving apparatus and method of the LCD device, the second data (Ro, Go and Bo) may be generated using the slope for the level which is set with reference to the average value (M) of histogram extracted from the brightness component (Y) of the first data (Ri, Gi and Bi). The LCD device may display more dynamic and vivid picture images. The light emitted from the backlight 38 may be controlled based on the brightness of pictures of one frame, whereby bright parts are further brightened and dark parts are further darkened.

Figure 8:
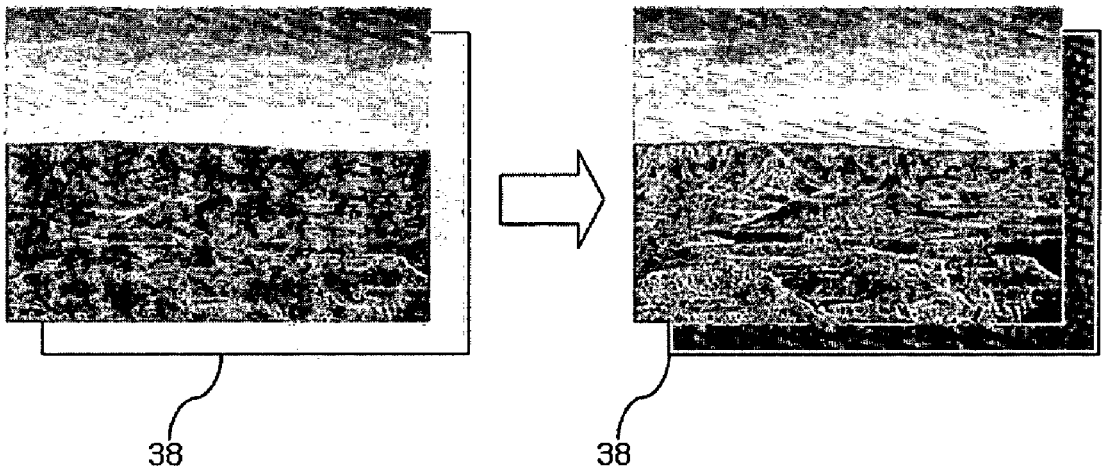
FIG. 8 illustrates photographs comparing images generated in the related art method with images generated in a histogram analyzing part.

FIG. 8 illustrates an application of the method, where the sky may be displayed more brightly, and the mountain may be displayed more darkly. The contrast may be improved with the average brightness. The brightness of light emitted from the backlight 38 and supplied to the LCD panel 22 is accordingly decreased by the average value (M) of the bright and dark portions. A tube current of the backlight 38 is adjusted to reduce the power consumption of the backlight 38.

Figure 9:
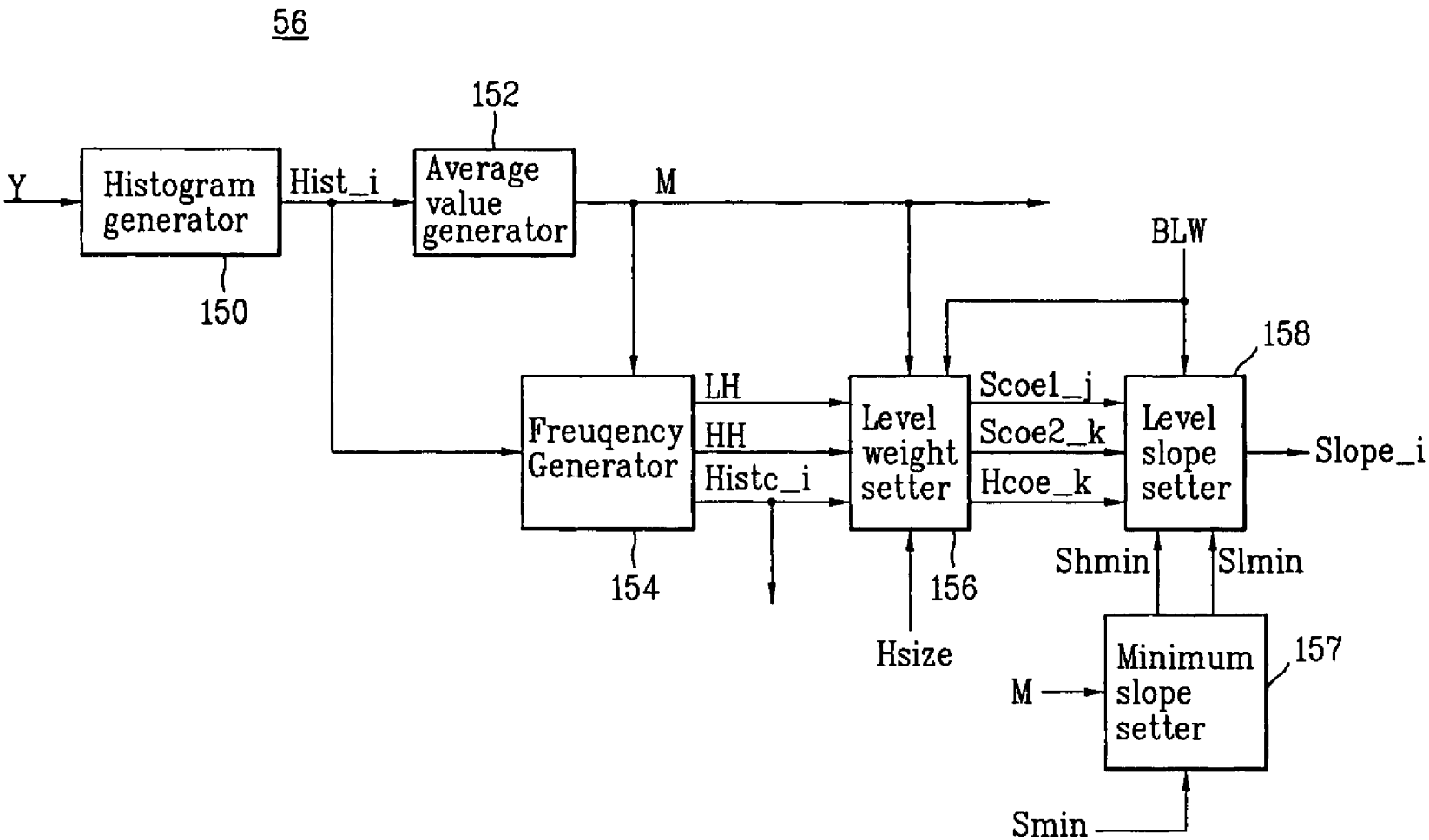
FIG. 9 is a block diagram of a histogram analyzing part.

FIG. 9 is a block diagram of a histogram analyzing part 56. As shown in FIG. 9, the histogram analyzing part 56 may include a histogram generator 150, an average value generator 152, a frequency generator 154, a level weight setter 156, a minimum slope setter 157, and a level slope setter 158.

Except for the minimum slope setter 157 and the level slope setter 158, the histogram analyzing part 56 illustrated in FIG. 9 may be identical in structure to that illustrated in FIG. 4. Accordingly, the above description for FIG. 4 may be substituted for the detailed explanation for the other structures except the minimum slope setter 157 and the level slope setter 158.

The histogram analyzing part 56 sets a minimum slope value (Slmin) for a low region in which an average value (M) of histogram is lower than an intermediate value (Histm) of levels, and a minimum slope value (Shmin) for a high region in which the average value (M) is higher than the intermediate value (Histm) by using a minimum slope value (Smin) inputted from the external source, and the level number (Histt) of the histogram (Hist_i), the intermediate value (Histm) of the level number (Histt) of the histogram (Hist_i), and the average value (M) of the histogram (Hist_i). Then, the histogram analyzing part 56 supplies the minimum slope value (Slmin) for the low region, and the minimum slope value (Shmin) for the high region to the level slope setter 158. The minimum slope value (Smin) input from the external is determined as a constant, such as between 0 and 1, so as to prevent the distortion of images caused by the extreme emphasis of the contrast ratio in the histogram level.

If the intermediate value (Histm) of the level number (Histt) of the histogram (Hist_i) is the same as or smaller than the average value (M) of the histogram (Hist_i), the minimum slope setter 157 sets the minimum slope value (Slmin) for the low region according to the level number (Histt), the intermediate value (Histm), the average value (M), and the minimum slope value (Smin), using the following equation 13. If the average value (M) of the histogram (Hist_i) is between the first to 'n/2' histogram levels (Hist_i to Hist_i/2), the minimum slope setter 157 sets the minimum slope value (Slmin) for the low region.

$$Slmin=1-(Histt-Histm)/(Histm-1)\times(1-Smin) \quad \text{[equation 13]}$$

If the intermediate value (Histm) of the level number (Histt) of the histogram (Hist_i) is larger than the average value (M) of the histogram (Hist_i), the minimum slope setter 157 sets the minimum slope value (Shmin) for the high region according to the level number (Histt), the intermediate value (Histm), and the minimum slope value (Smin) using the following equation 14. That is, if the average value (M) of the histogram (Hist_i) is between the 'n/2+1' and 'n' histogram levels (Hist_i/2+1 to Hist_i), the minimum slope setter 157 sets the minimum slope value (Shmin) for the high region. The minimum slope setter 157 sets the minimum slope values (Slmin and Shmin) for the low and high regions according to the average value (M) of the histogram with reference to the intermediate value (Histm) of the level number (Histt) of the histogram (Hist_i), to maintain the brightness of image.

$$Shmin=1-(1-Smin)\times(Histm-1)/(Histt-Histm) \quad \text{[equation 14]}$$

The level slope setter 158 sets the slope (slope_i) for each level of the histogram using the minimum slope values (slmin and Shmin) for the low and high regions input from the minimum slope setter 157, a backlight weight (BLW), a brightness weight (Hcoe_k) for each level of the second region, and first and second weights (Scoe1_j and Scoe2_k) for each level. The level slope setter 158 sets the slope (Slope_1 to Slope_M) for each level of the first region which is lower than the average value (M) using the minimum slope value (Slmin) for the low region, the backlight weight (BLW), and the weight (Scoe1_j) for each level of the first region, as expressed in the following equation 15.

$$Slope_j=BLW\times(Scoe1_j\times(1-Slmin)+Slmin) \quad \text{[equation 15]}$$

Also, the level slope setter 158 sets the slope (Slope_M) of the average value (M) according to the backlight weight (BLW), as expressed as the following equation 16.

$$Slope_M=BLW \quad \text{[equation 16]}$$

The level slope setter 158 sets the slope (Slope_M+1 to Slope_i) for the levels of the second region which are higher than the average value (M) using the minimum slope value (Shmin) for the high region, the weight (Scoe2_k) for the levels of the second region, and the brightness weight (Hcoe_k) for the levels of the second region, as expressed in the following equation 17.

$$Slope_k=Hcoe_k\times(Scoe2_k\times(1-Shmin)+Shmin) \quad \text{[equation 17]}$$

The level slope setter 158 sets the slope (Slope_1 to Slope_16) for the levels from 1 to 'i' levels of the histogram, for example, from 1 to 16 levels, and then supplies the slope for the levels of the histogram to a histogram modulating part 58.

Figure 10:
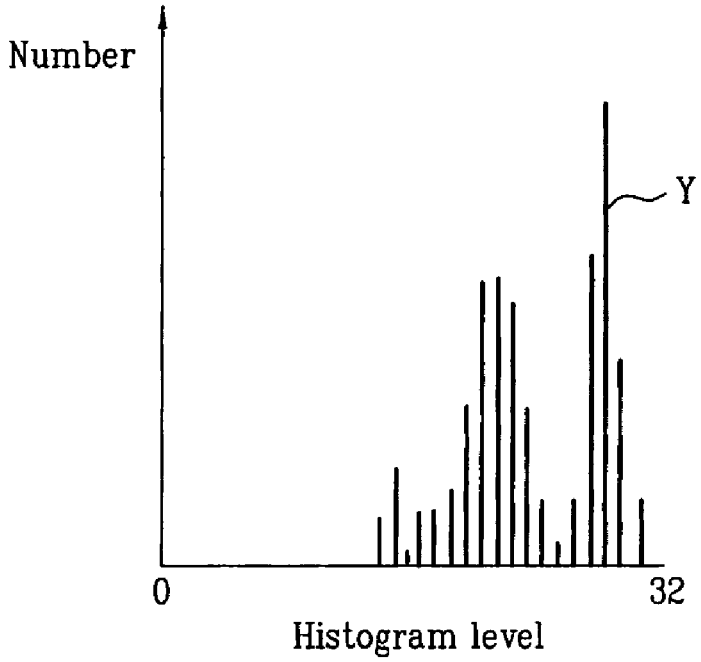
FIG. 10 is a histogram by levels generated in a histogram generator.
Figure 11:
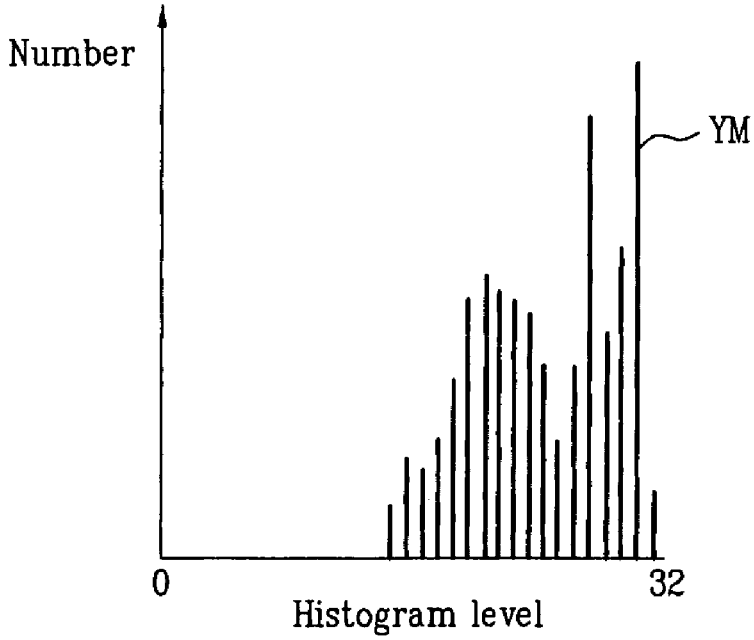
FIG. 11 is a modulated histogram by levels.
Figure 12:
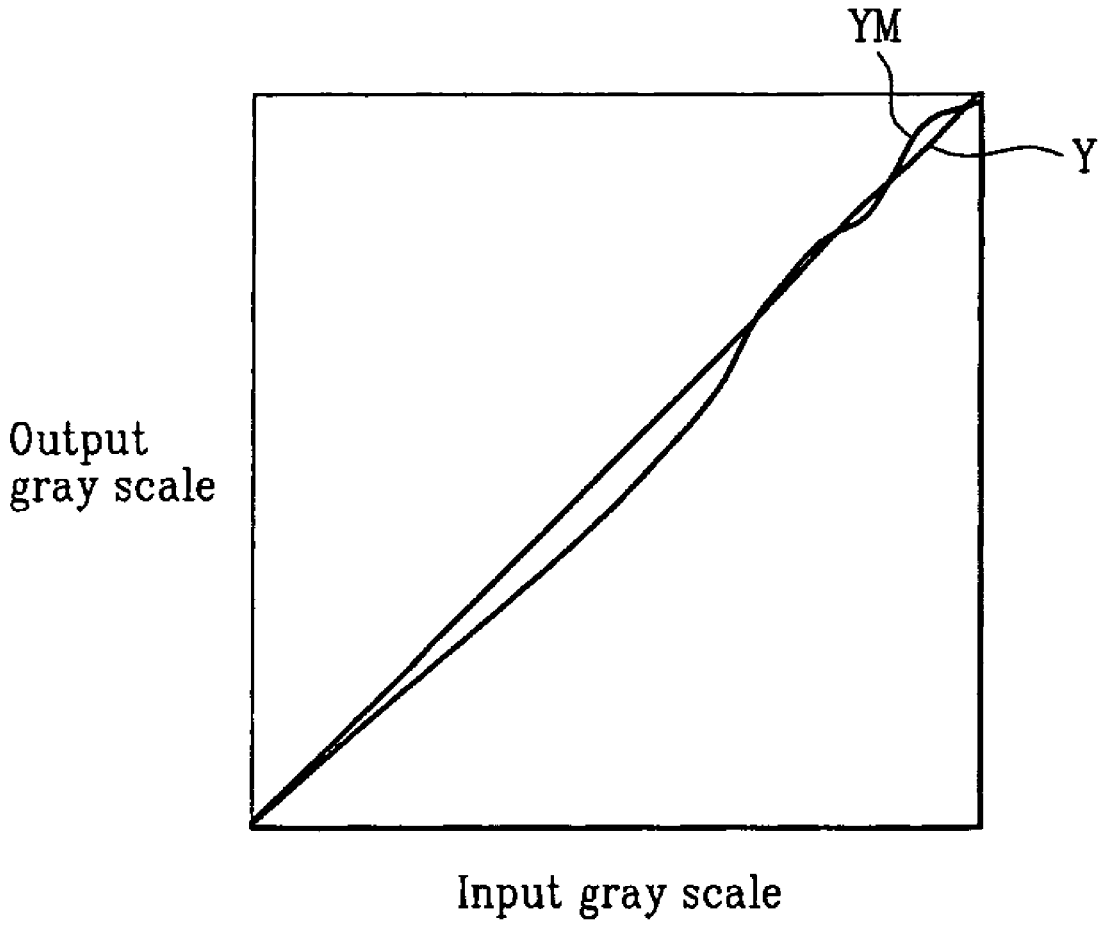
FIG. 12 is a graph of modulated brightness components.

The histogram modulating part 58 modulates brightness components (Y) supplied from a brightness/color dividing part 50, as expressed in the above equation 9 and shown in FIG. 10, to modulated brightness components (YM_i) by levels, using the slope (Slope_1 to Slope_16) for the levels of the histogram supplied from the histogram analyzing part 56, the present histogram level (X_i), the previous histogram level (Xoffset), and the histogram number (Yoffset) of the previous level. At this time, the modulated brightness component (YM) is distributed over the entire region, as shown in FIG. 12, thereby improving the contrast with the average brightness.

In a driving apparatus and method using the histogram analyzing part 56, the average value (M) of histogram is obtained by extracting the histogram of the plurality of levels from the brightness components (Y) of first data (Ri, Gi and Bi), and the slope for the levels are set by controlling the minimum slope values (Slmin and Shmin) for the low and high regions according to the average value (M) of the histogram based on the intermediate value (level) of the histogram levels. Thus, the driving apparatus and method of the LCD device may display dynamic and vivid images with clear contrast of brightness. The light emitted from the backlight 38 is controlled according to the brightness of pictures of one frame, whereby bright parts are further brightened and dark parts are further darkened.

Figure 13:
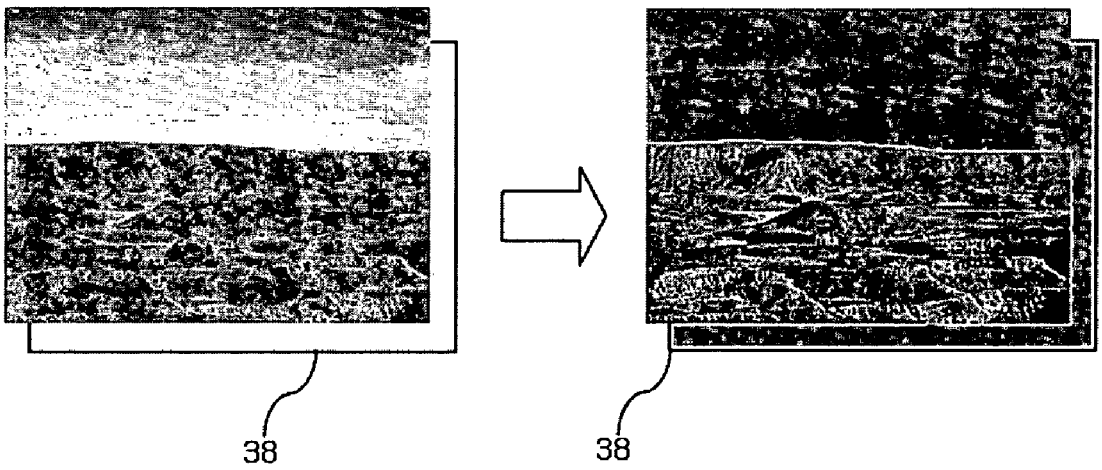
FIG. 13 illustrates photographs comparing images generated in the related art method with images generated in a histogram analyzing part.

FIG. 13 illustrates an application of the driving apparatus and method of FIG. 9. The sky may be displayed more brightly, and the mountain may be displayed more darkly, whereby the contrast may be improved along with the average brightness. The brightness of light emitted from the backlight 38 and supplied to the LCD panel 22 may be accordingly decreased by the average value (M) of the bright and dark portions. A tube current of the backlight 38 is adjusted to thereby reduce the power consumption of the backlight 38.

Figure 14:
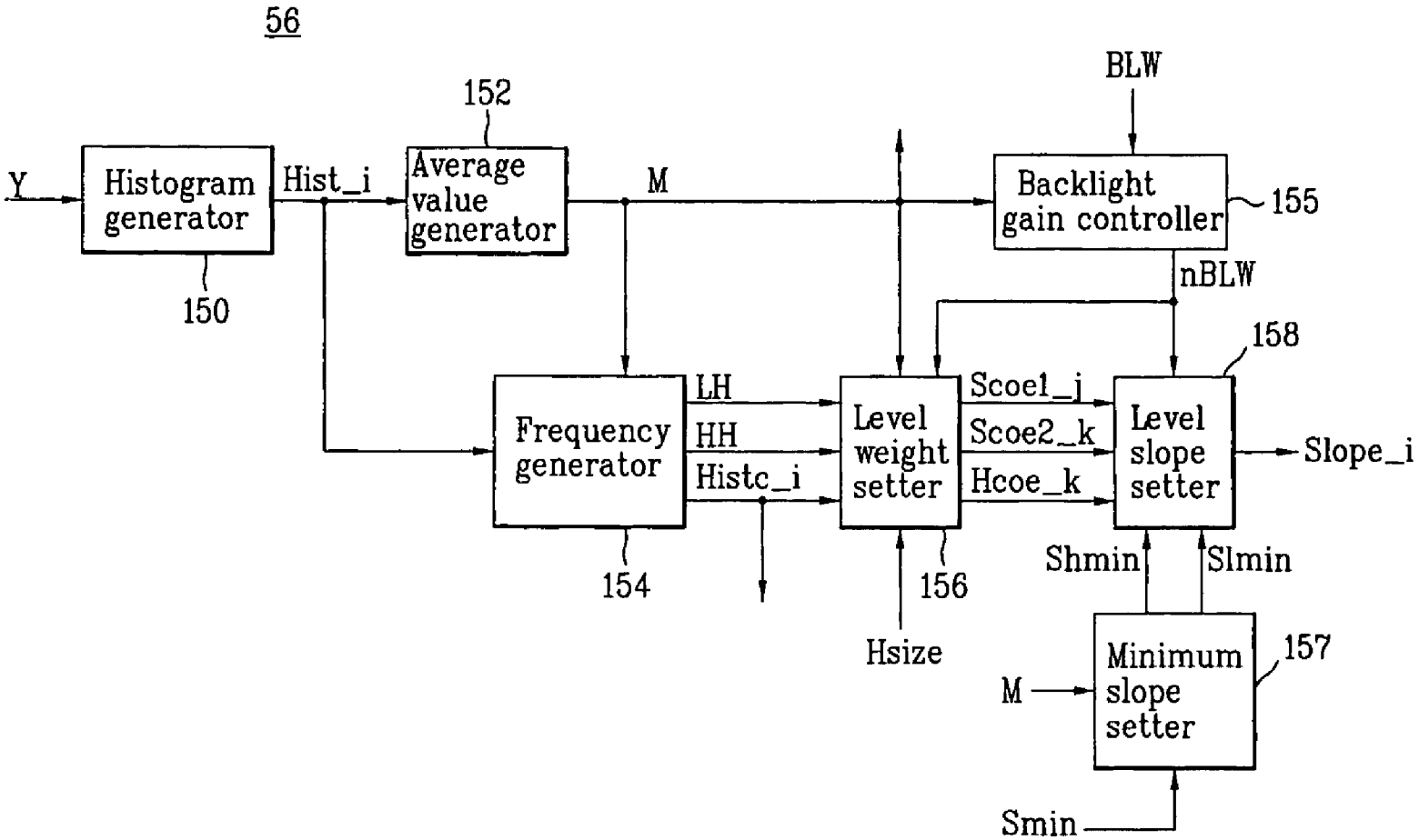
FIG. 14 is a block diagram illustrating a histogram analyzing part.

FIG. 14 is a block diagram of a histogram analyzing part 56. As shown in FIG. 14, the histogram analyzing part 56 may include a histogram generator 150, an average value generator 152, a frequency generator 154, a backlight gain controller 155, a level weight setter 156, a minimum slope setter 157, and a level slope setter 158. The histogram generator 150 and the average value generator 152 illustrated in FIG. 14 may be identical in structure as those of the illustrated in FIG. 4, whereby the explanation for the histogram generator 150 and the average value generator 152 illustrated in FIG. 14 will be omitted.

The backlight gain controller 155 generates a backlight gain value (nBLW) using a backlight weight (BLW) set by and supplied from a user, an average value (M) of the histogram, and a total level number (Histt) of the histogram (Hist_i). At this time, the backlight weight (BLW) is set as a constant, such as 1 to 2, which is input from the external source so as to compensate for a ratio of a minimum brightness and a maximum brightness according to first data (Ri, Gi and Bi). As expressed in the following equation 18, the backlight gain controller 155 subtracts '1' from the backlight weight (BLW), then divides the result by the total level number (Histt) of the histogram, then multiplies the negative result by the average value (M) of the histogram, and then adds the backlight weight (BLW) to the result, to thereby generate the backlight gain value (nBLW).

$$nBLW = -\left(\frac{BLW-1}{Histt}\right)\times M + BLW \quad \text{[equation 18]}$$

Figure 15:
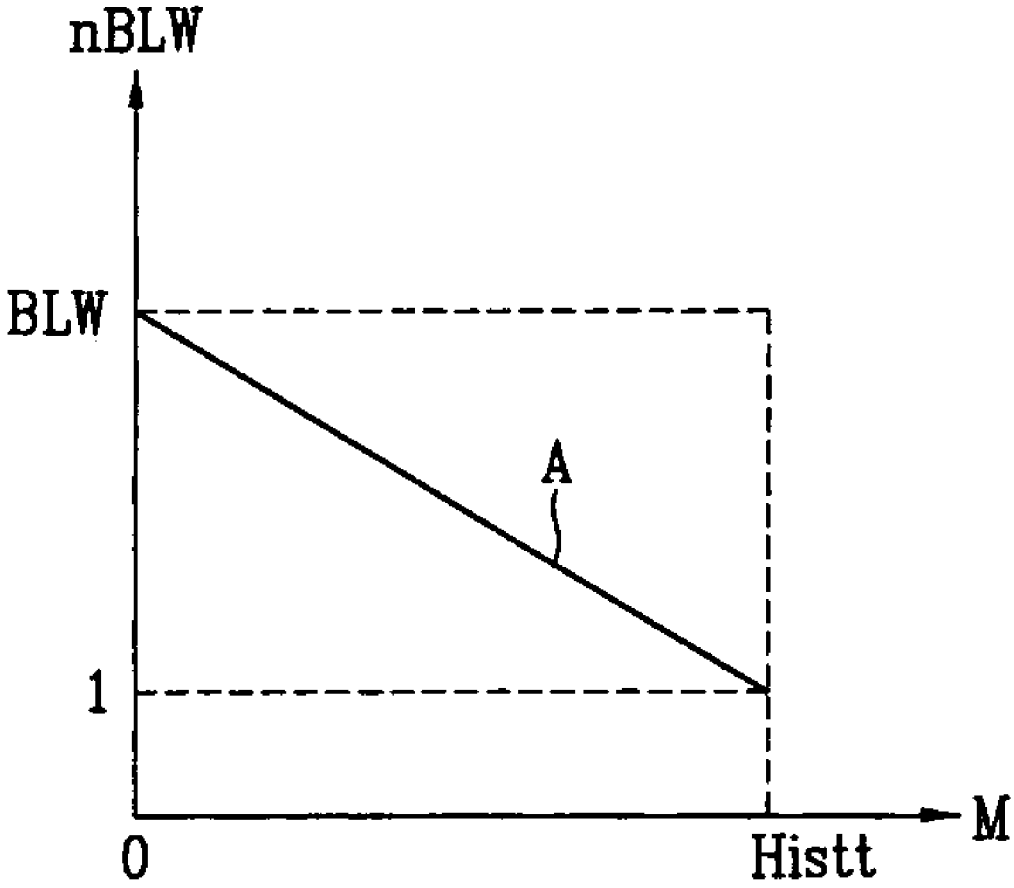
FIG. 15 is a graph illustrating a dynamic backlight gain value generated in a backlight gain controller.

Accordingly, as shown in FIG. 15, the backlight gain controller 155 generates the backlight gain value (nBLW) of the point corresponding to the total level number (Histt) of the histogram from a backlight gain graph (A) having a slope between the backlight weight (BLW) and the average value (M) of the histogram. The backlight gain controller 155 generates the dynamic backlight gain value (nBLW), thereby controlling the gain of image by the backlight. It may be possible to prevent the saturation of the image by controlling the gain of the backlight in the bright images and maintaining the brightness in the dark images.

The frequency generator 154 generates a cumulated histogram number (LH) of the first region which is lower than the average value (M) of the histogram, a cumulated histogram number (HH) of the second region which is higher than the average value (M) of the histogram, and a histogram number (Histc_i) for each level, according to the histogram (Hist_i) for the levels based on the average value (M) of the histogram.

The level weight setter 156 generates a weight (Scoe1_j) for each level of the first region, as expressed in the above equation 4, using the average value (M) of the histogram, the histogram number (Histc_i) for the levels, and the cumulated histogram number (LH) of the first region. Also, the level weight setter 156 sets a weight (Scoe2_k) for the levels of the second region, and a bright weight (Hcoe_k) for the levels of the second region, as expressed in the following equation 19, using the average value (M) of the histogram, the histogram number (Histc_i) for each level, and the respective cumulated histogram numbers (LH and HH) of the first and second regions, an adjacent histogram level (Hsize), and the backlight gain value (nBLW).

$$Scoe2_k=(Hsize-M)\times(Histc_i/HH)$$

$$Hcoe_k=(Hsize-nBLW\times M)/(Hsize-M) \quad \text{[equation 19]}$$

In the above equation 19, 'k' corresponds to the M to 32 levels.

The minimum slope setter 157 sets the minimum slope value (Slmin) of the low region wherein the average value (M) of the histogram is lower than the intermediate value (Histm) of the levels, and sets the minimum slope value (Shmin) of the high region wherein the average value (M) is higher than the intermediate value (Histm). Then, the minimum slope setter 157 supplies the minimum slope values (Slmin and Shmin) to the level slope setter 158. The detailed explanation for the minimum slope setter 157 will be omitted since the minimum slope setter 157 is in structure identical to that illustrated in FIG. 9.

The level slope setter 158 sets the slope (Slope_i) for the levels of the histogram, using the minimum slope values (Slmin and Shmin) of the low and high regions input from the minimum slope setter 157, the backlight gain value (nBLW), the brightness weight (Hcoe_k) for the levels of the second region, and the weights (Scoe1_j and Scoe2_k) for the levels of the first and second regions. Specifically, the level slope setter 158 sets the slope (Slope_1 to Slope_M) for the levels of the first region which are smaller than the average value (M), using the minimum slope value (Slmin) of the lower region, the backlight gain value (nBLW), and the weight (Scoe1_j) for the levels of the first region.

$$Slope_j=nBLW\times(Scoe1_j\times(1-Slmin)+Slmin) \quad \text{[equation 20]}$$

The level slope setter 158 sets the slope (Slope_M) of the average value (M) according to the backlight gain value (nBLW), as expressed as the following equation 21.

$$Slope_M=nBLW \quad \text{[equation 21]}$$

The level slope setter 158 sets the slope (Slope_M+1 to Slope_i) for the levels of the second region which are higher than the average value (M) using the minimum slope value (Shmin) for the high region, the weight (Scoe2_k) for each level of the second region, and the brightness weight (Hcoe_k) for the levels of the second region, as expressed in the above equation 17. Also, the level slope setter 158 sets the slope (Slope_1 to Slope_16) of the histogram for the levels from 1 to 32 levels, and then supplies the slope of the histogram for the levels to a histogram modulating part 58.

The level slope setter 158 may use the minimum slope value (Smin) input from the external source instead of the minimum slope values (Slmin and Shmin) of the low and high regions input from the minimum slope setter 157. For this, the level slope setter 158 sets the slope (Slope_i) for each level of the histogram, using the minimum slope value (Smin), the backlight gain value (nBLW), the brightness weight (Hcoe_k) for the levels of the second region, and the weights (Scoe1_j and Scoe2-K) for the levels of the first and second regions. The minimum slope value (Smin) may be set as a constant between 0 and 1, so as to prevent the distortion of original image caused by the extreme emphasis of the contrast ratio in the histogram level.

The level slope setter 158 sets the histogram slope (Slope_1 to Slope_M) for the levels of the first region which are smaller than the average value (M), using the minimum slope value (Smin), the backlight gain value (nBLW), and the weight (Scoe1_j) for the levels of the first region, as expressed in the following equation 22.

$$Slope_j=nBLW\times(Scoe1_j\times(1-Smin)+Smin) \quad \text{[equation 22]}$$

The level slope setter 158 sets the slope (Slope_M) of the histogram level having the average value (M) according to the backlight gain value (nBLW), as expressed in the above equation 21. The level slope setter 158 sets the slope (Slope_M+1 to Slope_i) for the levels of the second region which is higher than the average value (M) using the minimum slope value (Shmin), the weight (Scoe2_k) for each level of the second region, and the brightness weight (Hcoe_k) for the levels of the second region, as expressed in the above equation 8. The level slope setter 158 sets the slope (Slope_1 to Slope_32) for the levels from 1 to 32 levels of the histogram, and supplies the slope to the histogram modulating part 58. The data modulation module 70 may include the histogram analyzing part 56 to maintain the brightness in the dark image, and controls the gain of the backlight in the bright images, thereby preventing the saturation of the images.

The modulation process of the bright images in the data modulation module 70 will be explained as follows.

Figure 16A:
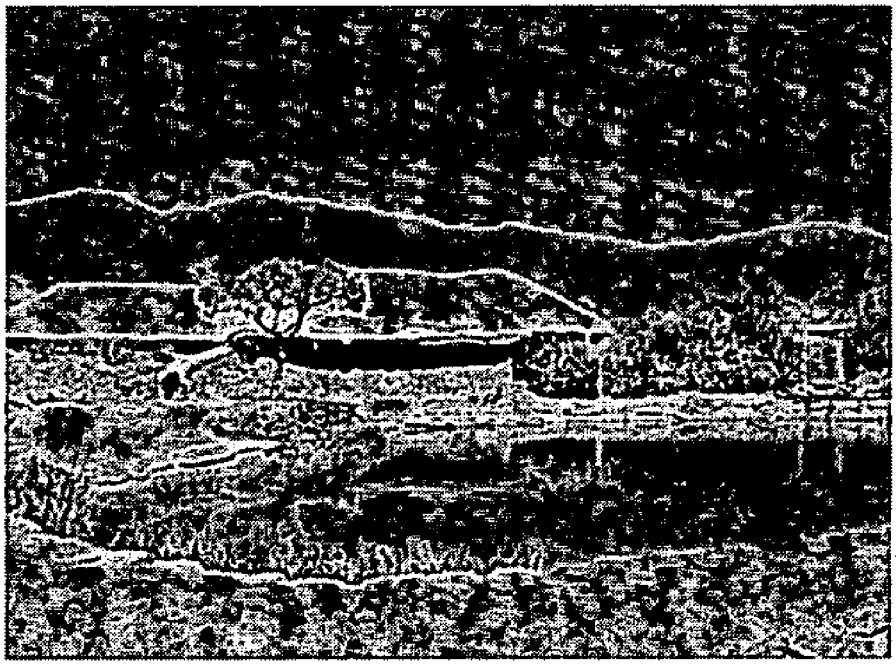
FIGS. 16A to 16E illustrate a data modulation of a bright image by a data modulation unit comprising a histogram analyzing part.
Figure 16B:
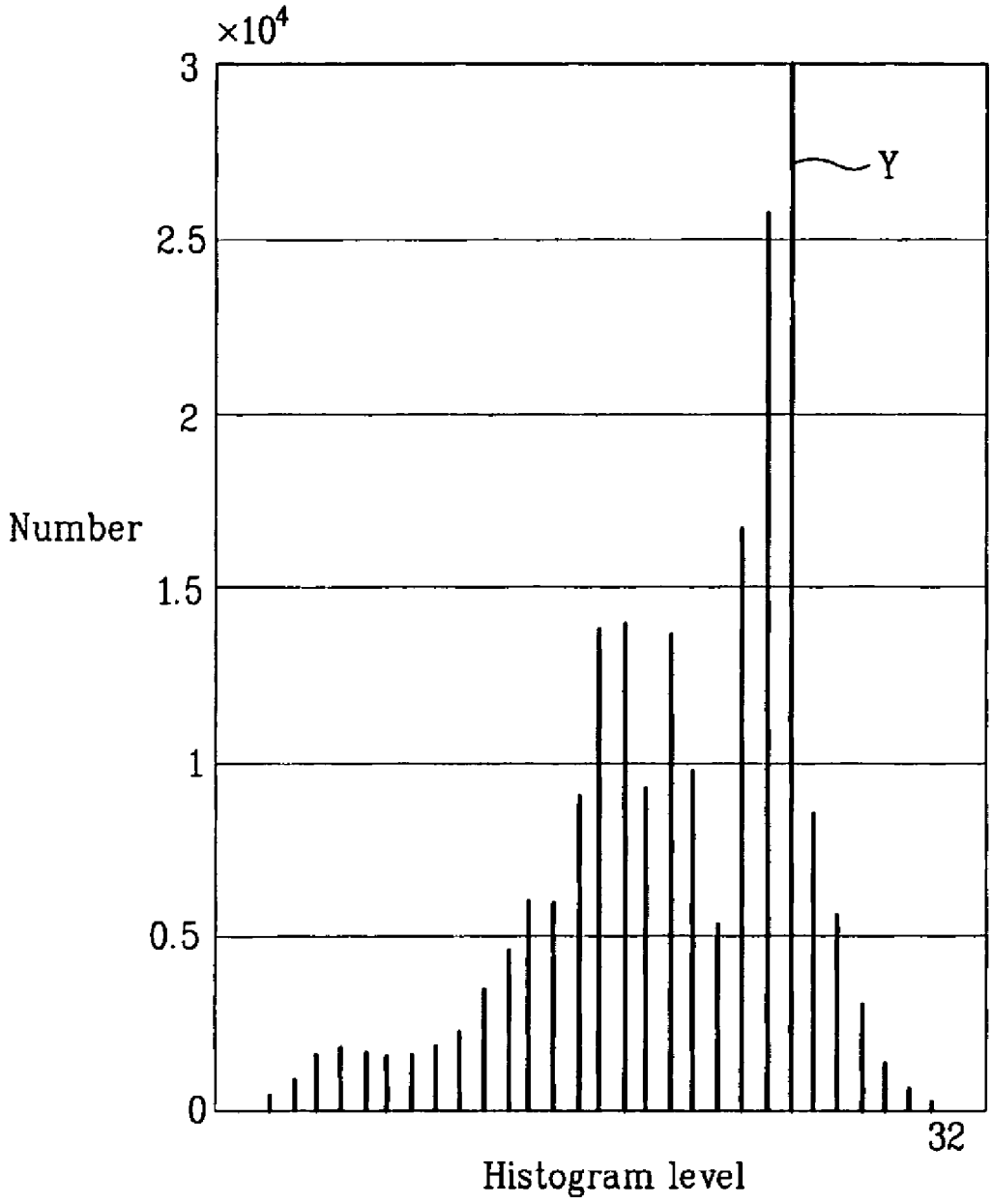

As shown in FIG. 16A, data of the bright images is divided into brightness components (Y) and color-difference components (U and V), according to the equations 1 to 3. Then, as shown in FIG. 16B, the brightness components (Y) are divided by 32 levels, thereby generating the histogram (Hist_i) by levels. Then, the average value (M) of the histogram (Hist_i) having 32 levels is obtained.

The backlight gain value (nBLW) is obtained to control the saturation of images caused by the gain of the backlight, using the backlight weight (BLW), the total level number of the histogram, and the average value (M) of the histogram. There may be a requirement for generating the cumulated histogram number (LH) of the first region which is smaller than the average value (M) of the histogram, the cumulated histogram number (HH) of the second region which is higher than the average value (M) of the histogram, and the histogram number (Histc_i) for each level, according to the histogram (Hist_i) by levels. Then, the weight (Scoe1_j and Scoe2_k)

for each level of the first and second regions and the brightness weight (Hcoe_k) for each level of the second region are set using the equations 4 and 19.

By the equations 13, 14, 17, 20 and 21, the slope (Slope_i) for the levels of the histogram may be set by controlling the minimum slope values (Slmin and Shmin) of the low and high regions according to the average value (M) of the histogram based on the intermediate value of 32 levels of the histogram. The slope (Slope_i) for the levels of the histogram may be set controlling the minimum slope value (Smin) based on the average value (M) of the histogram with reference to the intermediate value of 32 levels of the histogram by the equations 8, 21 and 22.

Figure 16C:
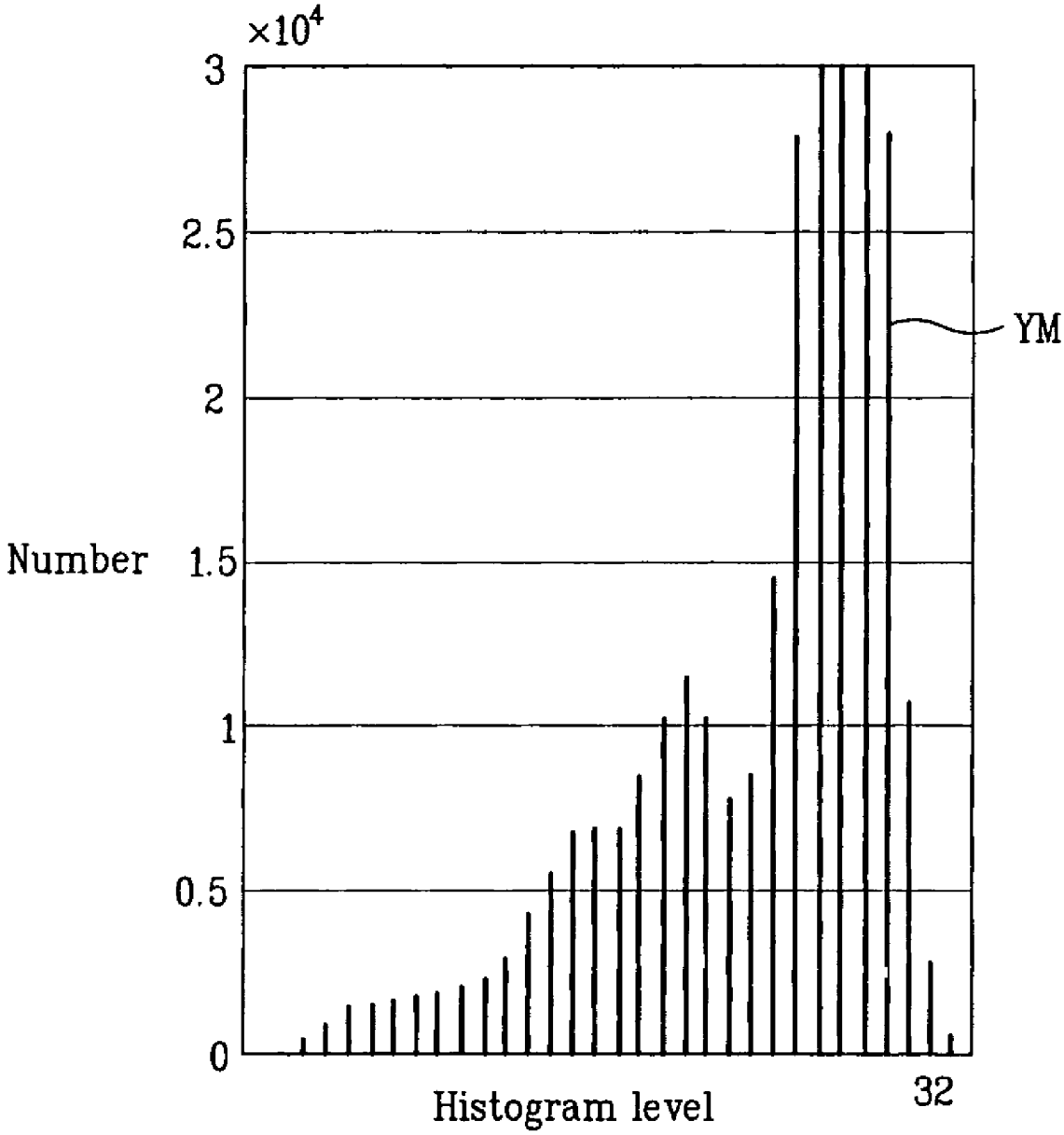
Figure 16D:
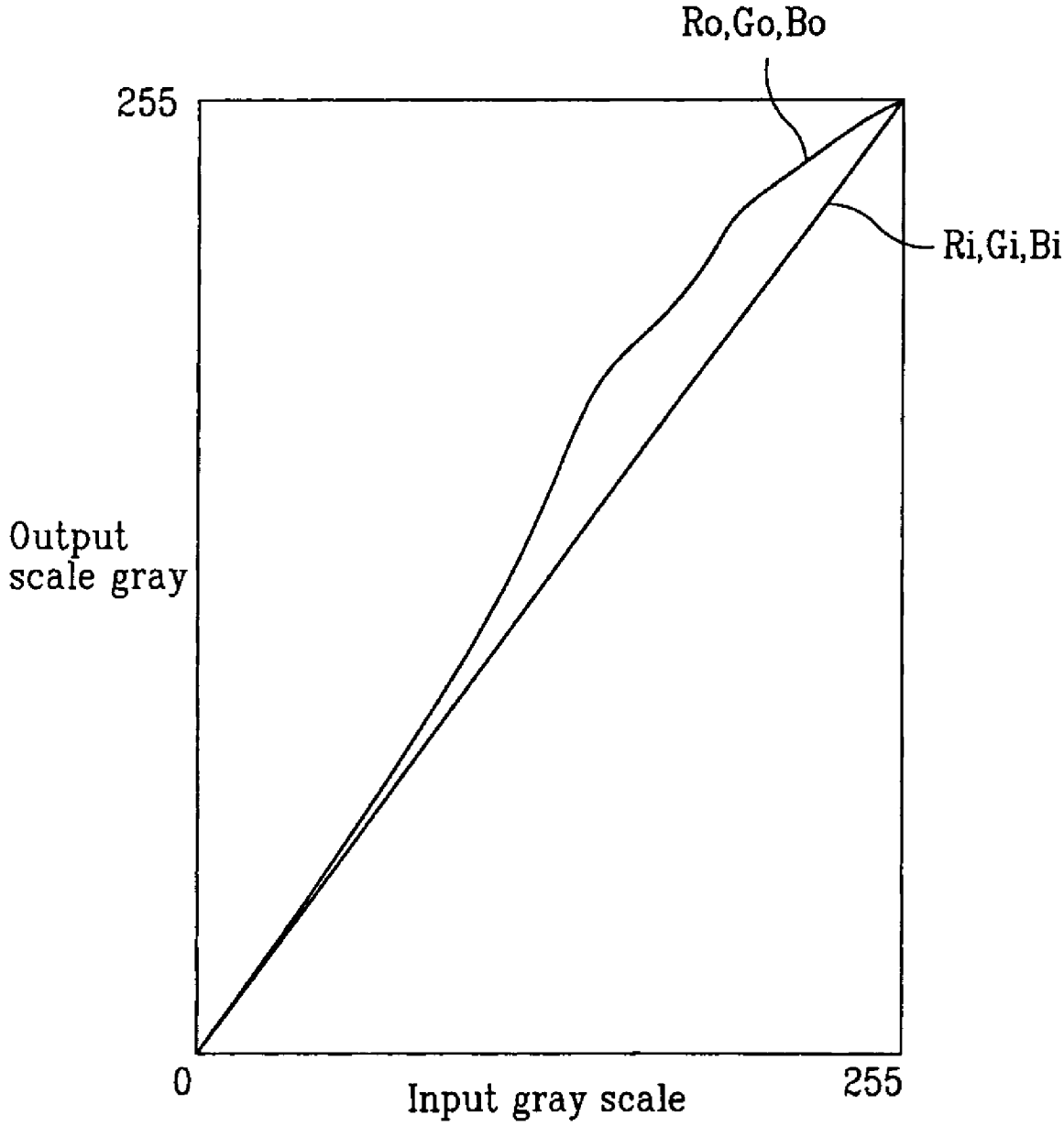
Figure 16E:
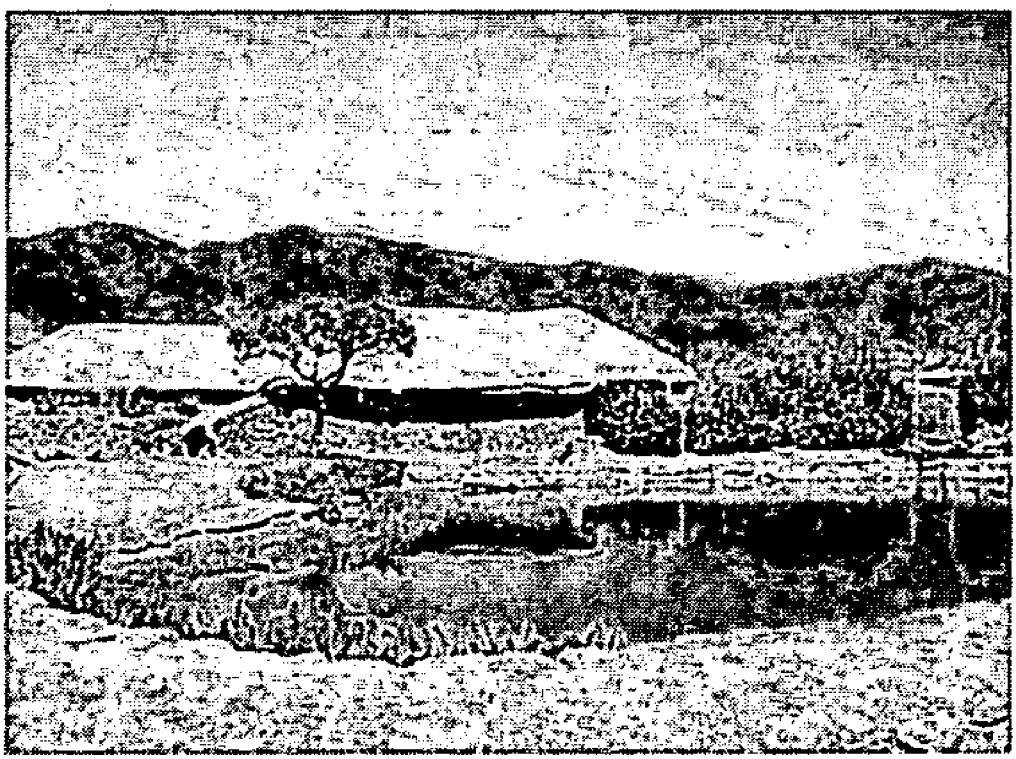

By using the slope (Slope_i) for the levels of the histogram, as shown in FIG. 16C, the modulated brightness component (YM_i) for the levels, having the extended contrast ratio, is generated using the slope (Slope_i) for the levels of the histogram by the backlight gain value (nBLW). As shown in FIG. 16D, the data modulation module 70 may prevent the high-brightness portion in the bright-image from being saturated. It may be possible to improve the contrast ratio in the entire brightness, as shown in FIG. 16E, thereby obtaining dynamic and vivid images. In FIG. 16D, the X-axis corresponds to the input gray scale, and the Y-axis corresponds to the output gray scale.

Figure 17A:
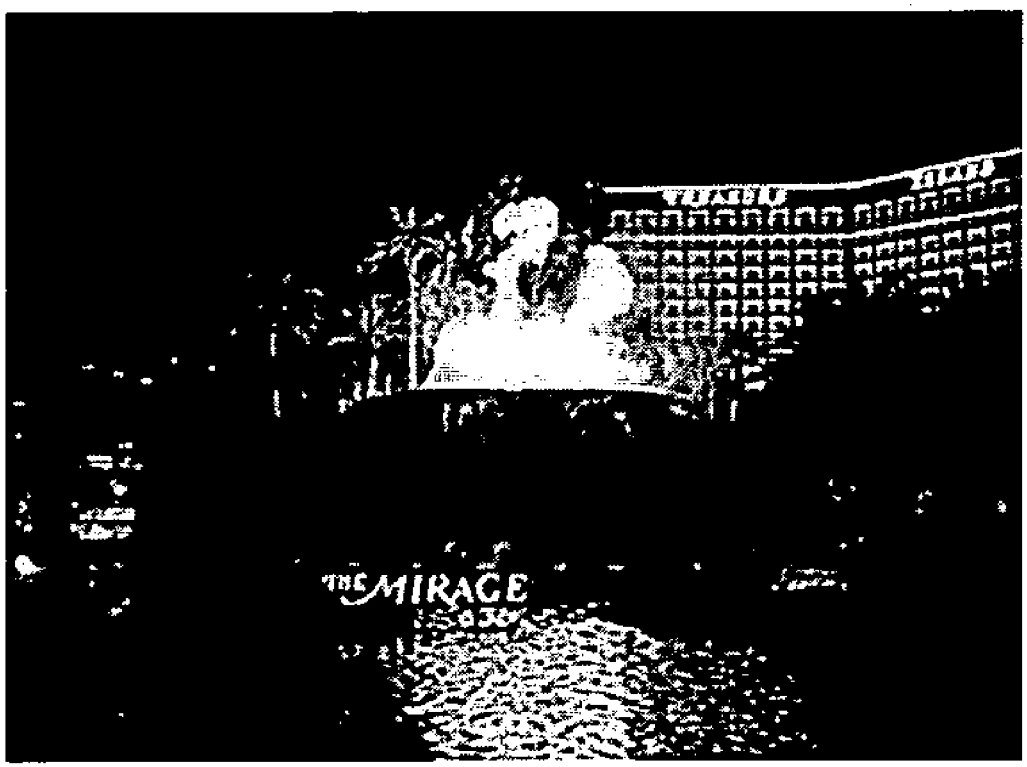
FIGS. 17A to 17E are illustrate a data modulation of a dark image by a data modulation unit comprising a histogram analyzing part.
Figure 17B:
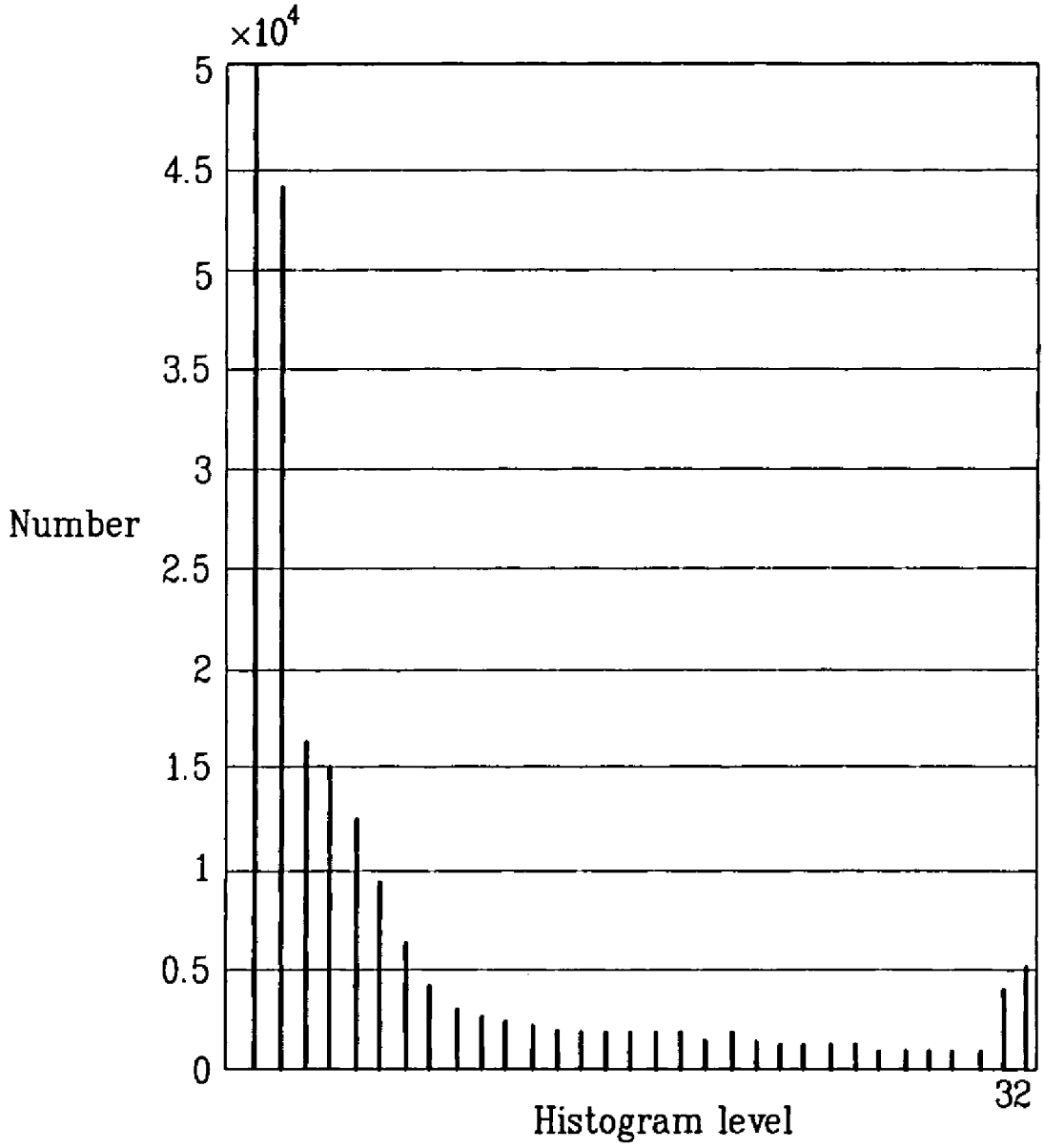
Figure 17C:
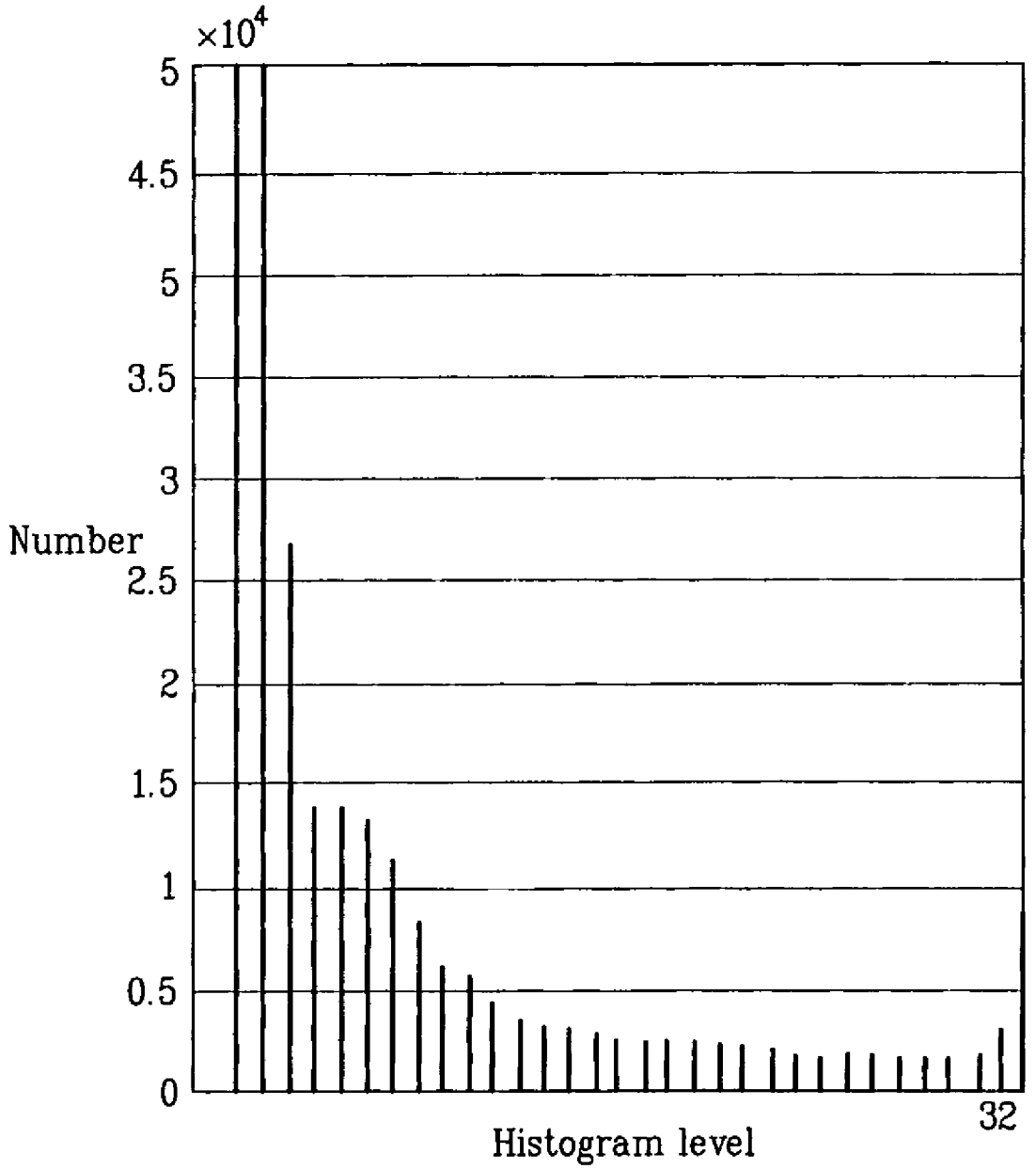
Figure 17D:
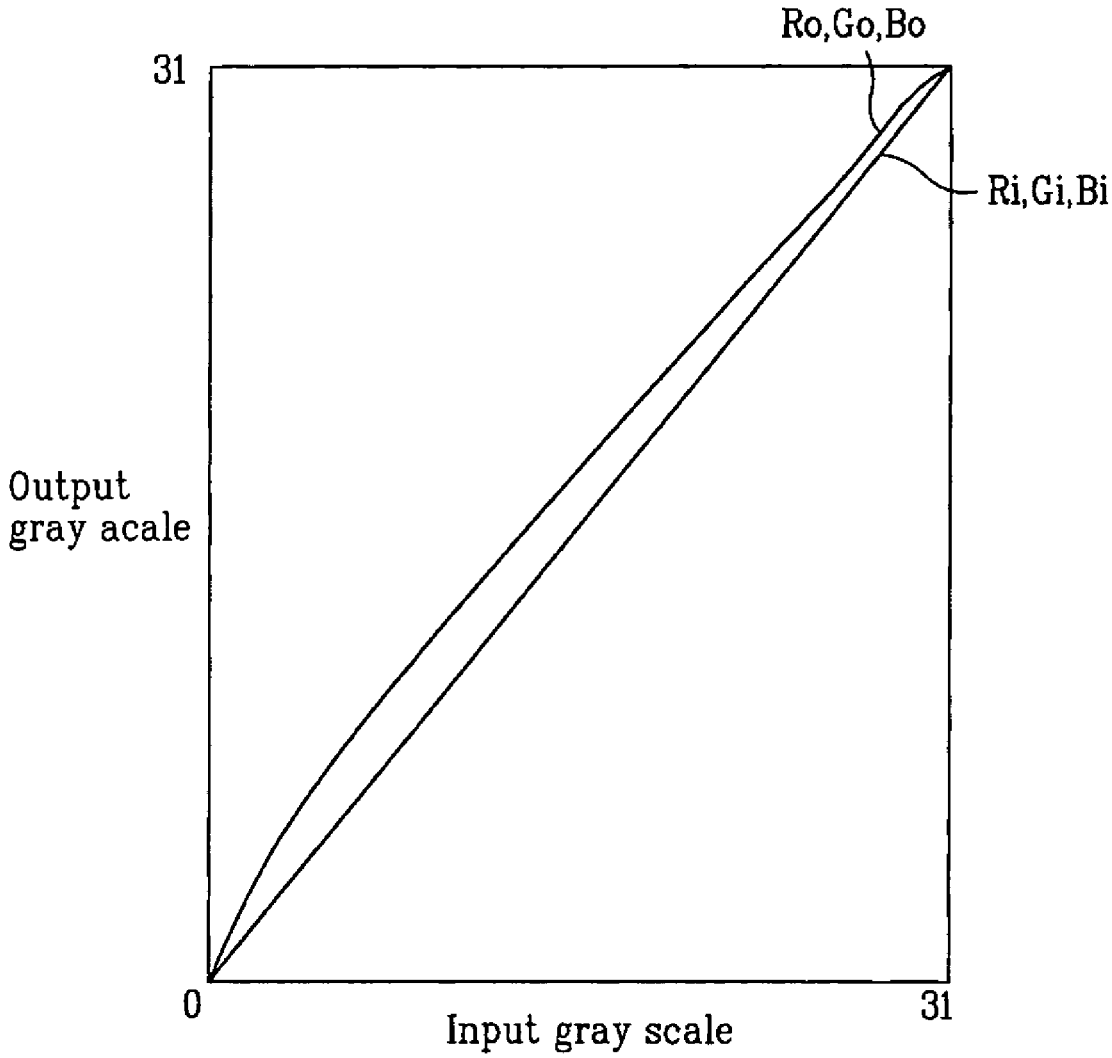
Figure 17E:
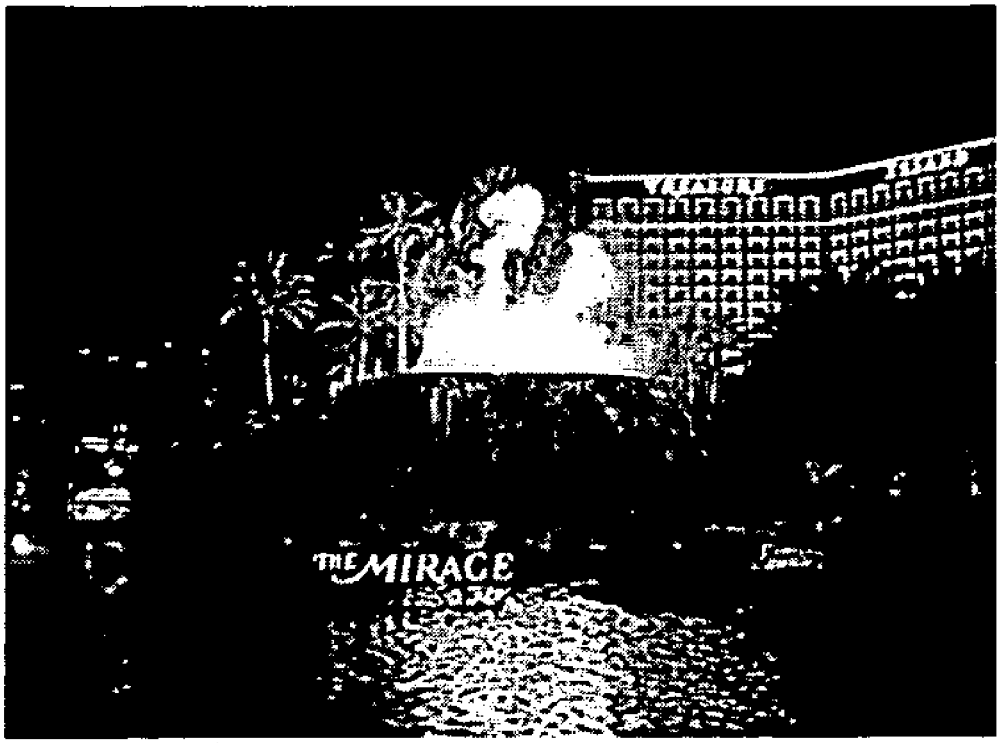

For the dark image shown in FIG. 17A, the data modulation module 70 modulates the brightness component (Y) of the input image in the modulation process from FIGS. 17B to 17D, to improve the contrast ratio of the entire brightness as shown in FIG. 17E.

The driving apparatus and method of the LCD device illustrated in FIG. 4, which includes the histogram analyzing part 56 illustrated in FIG. 14, generates the dynamic backlight gain value (nBLW) using the backlight weight (BLW) and the histogram extracted from the brightness component (Y) of the first data (Ri, Gi and Bi), and generates the second data (Ro, Go and Bo) by setting the slope for the levels of the histogram with the dynamic backlight gain value (nBLW). It may be possible to improve the contrast ratio of the display brightness by controlling the data saturation caused by the increase of backlight gain in the bright image, thereby obtaining a dynamic and vivid image.

Figure 18:
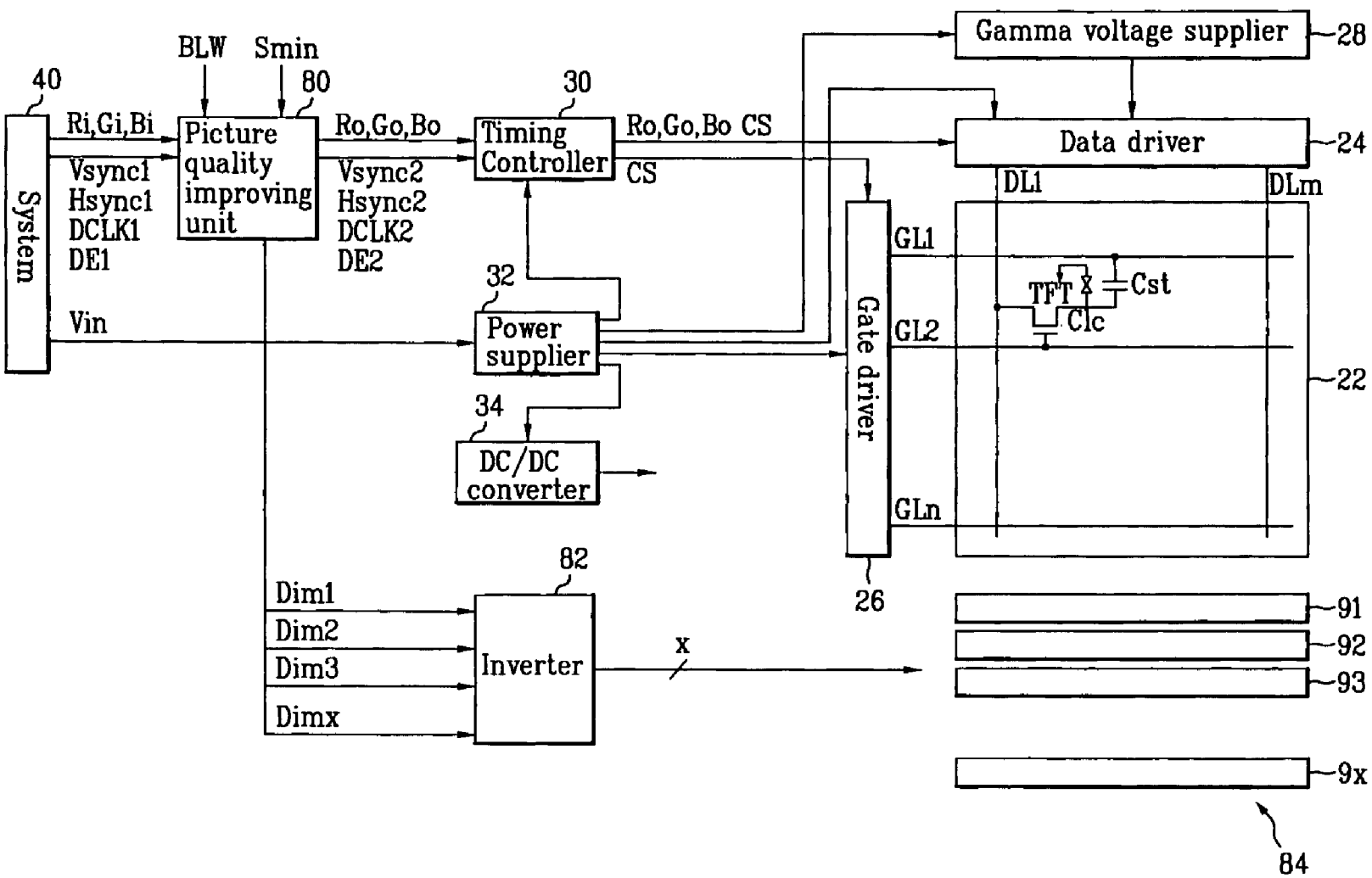
FIG. 18 is a block diagram of a driving apparatus of an LCD device.
Figure 19:
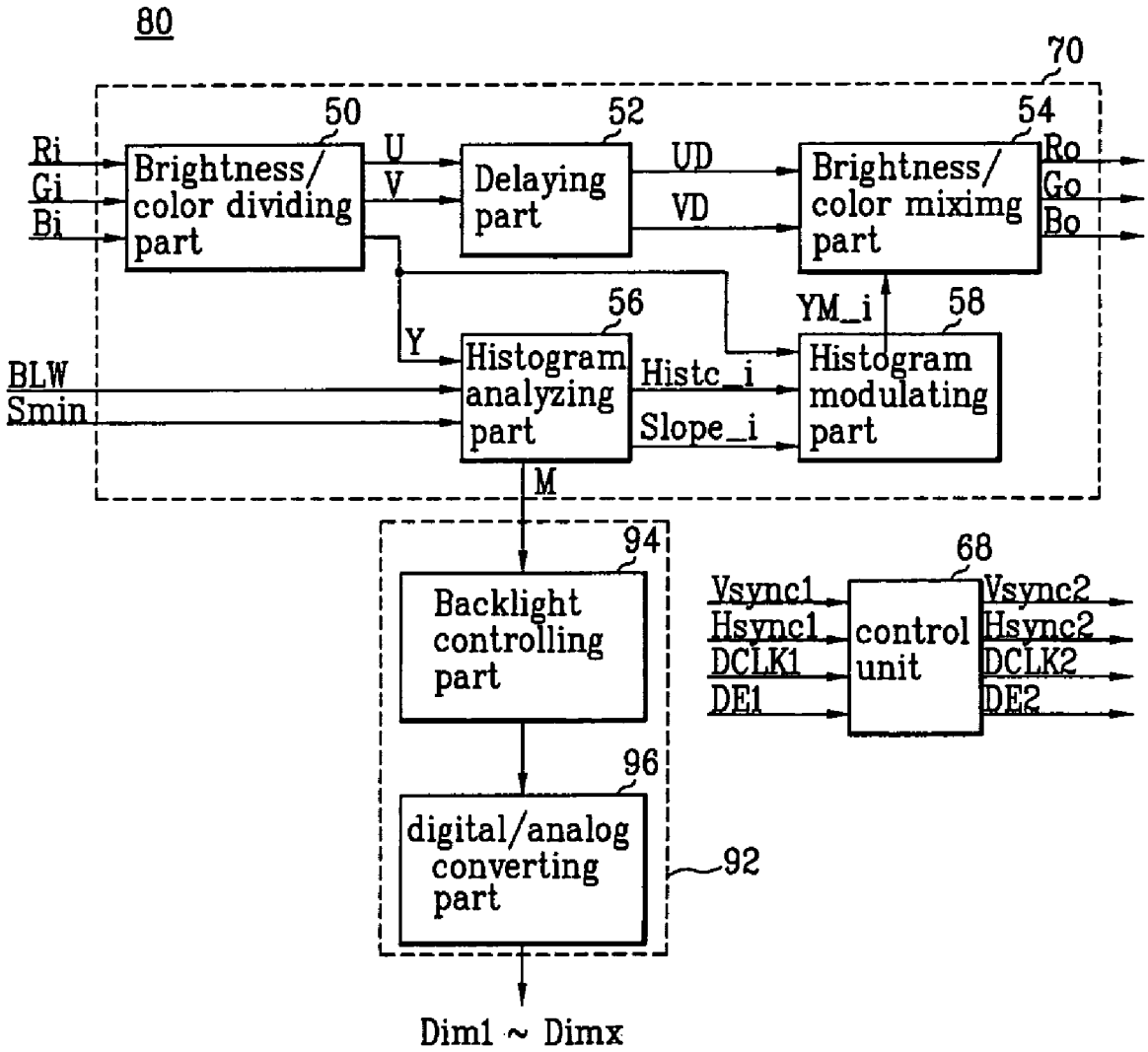
FIG. 19 is a block diagram of a picture quality improving.

FIG. 18 is a block diagram of a driving apparatus of an LCD device. FIG. 19 is a block diagram of a picture quality improving unit of FIG. 18.

As shown in FIGS. 18 and 19, the driving apparatus of the LCD device is provided with an LCD panel 22, a data driver 24, a gate driver 26, a picture quality improving unit 80, a timing controller 30, a backlight 84, and an inverter 82. The driving apparatus of the LCD device further includes a system 40, a gamma voltage supplier 28, a power supplier 32, and a DC/DC converter 34.

Accordingly, the above description of the LCD device illustrated in FIG. 4 will substitute for the detailed explanation for the structures except for the picture quality improving unit 80, the inverter 82, and the backlight 84.

The picture quality improving unit 80 of the driving apparatus a may include a data modulation module 70, a backlight control module 92, and control unit 68. Except the backlight control module 92, the picture quality improving unit is identical in structure to the picture quality improving unit 42 shown in FIG. 3. Accordingly, the above description of the LCD device illustrated in FIG. 3 will substitute for the detailed explanation for the other structures except the backlight control module 92.

The backlight control module 92 may generate a plurality of brightness control signals (Dim1 to Dimx) related to an average value (M) of histogram, and supply the plurality of brightness control signals (Dim1 to Dimx) to the inverter 82. The backlight control module 92 includes a backlight controlling part 94 and a digital/analog converting part 96.

The backlight controlling part 94 generates the plurality of brightness control signals (Dim1 to Dimx). At this time, if the average value (M) has a high level of brightness, the backlight controlling part 94 generates the plurality of brightness control signal (Dim1 to Dimx) to produce a light of higher brightness. However, if the average value (M) has a lower brightness, the backlight controlling part 94 generates the plurality of brightness control signals (Dim1 to Dimx) to produce a light of lower brightness. The digital/analog converting part 96 converts the plurality of brightness control signals (Dim1 to Dimx) to analog control signals, and supplies the analog control signals to the inverter 82.

The inverter 82 supplies a plurality of lamp driving voltages in accordance with the analog control signals (Dim1 to Dimx) to the backlight 84. The backlight 84 is formed in a direct type comprising a plurality of lamps (91 to 9x, where x is a natural number). At this time, the plurality of lamps (91 to 9x) are positioned in the rear surface of the LCD panel 22. The plurality of lamps (91 to 9x) emit a light related to the plurality of lamp driving voltages, and provides the generated light to the LCD panel 22.

The plurality of lamps (91 to 9x) may be positioned. in correspondence with 'x' regions of the LCD panel 22. The LCD panel 22 may be divided into 'x' regions illuminated with the light emitted from the plurality of lamps (91 to 9x).

The backlight controlling part 94 generates the plurality of brightness control signals (Dim1 to Dmix) corresponding to data supplied to 'x' regions of the LCD panel 22. The backlight 84 separately drives the respective lamps (91 to 9x) corresponding to the lamp driving voltages supplied from the inverter 82 according to the average value (M). It may be possible to provide the light to each of 'x' regions of the LCD panel 22 by separately driving the plurality of lamps (91 to 9x).

In the driving apparatus and method of the LCD device, the bright colors may be displayed more brightly and the dark colors may be displayed more darkly in the LCD panel. The brightness of the backlight may be controlled by the brightness of image of one frame, to obtain the dynamic and vivid image and to selectively emphasize the brightness of the displayed image.

In the driving apparatus and method of the LCD device a, the histogram is obtained by dividing the brightness components of the input data into levels, and the slope for the levels of the histogram may be set using the average value of the histogram, thereby improving the contrast ratio and maintaining the average brightness of the displayed image. Furthermore, the brightness of the backlight may be controlled based on the average value of the histogram, thereby obtaining a dynamic and vivid image.

The minimum slope values of the low and high regions may be set with reference to the intermediate value of the histogram total level number, so that it is possible to prevent the distortion of the brightness caused by the extension of the contrast ratio.

After extracting the histogram by dividing the brightness components of the input data into levels, the slope for each level of the histogram may be set using the backlight gain value according to the histogram and the backlight weight. It may be possible to prevent the high-brightness portion in the bright image from being saturated, and to improve the contrast ratio and maintain the brightness of the original image. The dynamic and vivid image is displayed in the LCD panel by controlling the brightness of the backlight according to the average value of the histogram.

It will be apparent to those skilled in the art that various modifications and variations can be made in the LCD device and method without departing from the spirit or scope of the disclosure. Thus, it is intended that the disclosure cover the modifications and variations of this invention provided they come within the scope of the appended claims and their equivalents.

What is claimed is:

1. A driving apparatus of an LCD device, having an LCD panel, a data driver, a gate driver, and a backlight that provides a light to the LCD panel, comprising:

a picture quality improving unit configurable to:

generate a histogram by dividing brightness components of input first data into levels;

generate second data having an extended contrast ratio related to a brightness of the histogram by levels using a calculated value of the histogram; and generate at least one brightness control signal related to the calculated value of the histogram;

a timing controller configurable to supply the second data arranged and control the data driver and the gate driver; and an inverter configurable to drive the backlight based on the brightness control signal.

2. The driving apparatus of claim 1, wherein the picture quality improving unit comprises:

a data modulator configurable to generate the second data using the first data;

a backlight controller configurable to generate at least one brightness control signal under control of the data modulation means; and a control unit configurable to receive a first synchronization signal from an external source, modulating the first synchronization signal in synchronization with the second data, and supplying the modulated first synchronization signal to the timing controller.

3. The driving apparatus of claim 2, wherein the data modulator comprises:

a brightness/color divider configurable to divide the first data into brightness components and color-difference components;

a histogram analyzer configurable to generate the histogram by dividing the brightness component of the first data by levels and analyzing a histogram number and a slope for each level of the histogram based on a calculated value of the histogram;

a histogram modulator configurable to generate modulated brightness components of extended contrast ratio by using the histogram number and slope for each level of the histogram;

a delay unit configurable to generate delayed color-difference components by delaying the color-difference components the modulated brightness component is generated in the histogram modulator; and a brightness/color mixer configurable to generate the second data by mixing the modulated brightness component and the delayed color-difference component.

4. The driving apparatus of claim 3, wherein the histogram analyzer comprises:

a histogram generator configurable to generate the histogram by dividing the brightness component of the first data into levels;

a calculator configurable to generate the calculated value by cumulating the histogram;

a frequency generator configurable to generate a cumulated histogram number of a first region which is smaller than the calculated value, a cumulated histogram number of a second region which is larger than the calculated value, and a histogram number for each level of the histogram, by using the histogram and the calculated value;

a level weight setter configurable to set a weight for each level of the first and second regions, and a brightness weight for each level of the second region, by using a backlight weight supplied from an external source, the cumulated histogram number of the first region, the cumulated histogram number of the second region, the calculated value, and the histogram number; and a level slope setter configurable to set a slope for each level of the histogram by using a minimum slope value supplied from the external source, the backlight weight, the weight for each level of the first and second regions, and the brightness weight for each level of the second region.

5. The driving apparatus of claim 4, wherein the level weight setter is configurable to set the weight for each level of the first region by determining a function represented by (calculated value−1)×(histogram number for each level/cumulated histogram number of first region); setting the weight for each level of the second region by determining a function represented by (adjacent histogram level−calculated value)×(histogram number for each level/cumulated histogram number of second region); and setting the brightness weight for each level of the second region by (adjacent histogram level−backlight weight×calculated value)/(adjacent histogram level−calculated value).

6. The driving apparatus of claim 4, wherein the level slope setter is configurable to set the slope for each level of the first region by determining a function represented by backlight weight×(weight for each level of first region×(1−minimum slope value)+minimum slope value); set the slope of the histogram level having the calculated value by the backlight weight; and set the slope for each level of the second region by determining a function represented by brightness weight for each level of second region×(weight for each level of second region×(1−minimum slope value)+minimum slope value).

7. The driving apparatus of claim 3, wherein the histogram analyzer comprises:

a histogram generator configurable to generate the histogram by dividing the brightness component of the first data into brightness levels;

a calculator configurable to generate the calculated value by cumulating the histogram;

a frequency generator configurable to generate a cumulated histogram number of a first region which is smaller than the calculated value, a cumulated histogram number of a second region which is larger than the calculated value, and a histogram number for each level of the histogram, by using the histogram and the calculated value;

a level weight setter configurable to set a weight for each level of the first and second regions, and a brightness weight for each level of the second region, by using a backlight weight supplied from the external, the cumulated histogram number of the first region, the cumulated histogram number of the second region, the calculated value, and the histogram number;

a minimum slope setter configurable to set a minimum slope value for a low region if the calculated value of the histogram is lower than an intermediate value of the levels, or a minimum slope value for a high region if the calculated value is higher than the intermediate value by using a minimum slope value input from the external source, the calculated value, a total level number of the histogram, and the intermediate value of levels of the histogram; and a level slope setter configurable to set a slope for the level of the histogram using the minimum slope values of the low and high regions, the backlight weight, the weight for a level of the first and second regions, and the brightness weight for a level of the second region.

8. The driving apparatus of claim 7, wherein the level weight setter is configurable to set the weight for the level of the first region by determining a function represented by (calculated value−1)×(histogram number for each level/cumulated histogram number of first region), set the weight for the level of the second region by determining a function represented by (adjacent histogram level−calculated value)×(histogram number for each level/cumulated histogram number of second region), and set the brightness weight for the level of the second region by determining a function represented by (adjacent histogram level−backlight weight×calculated value)/(adjacent histogram level−calculated value).

9. The driving apparatus of claim 8, wherein the minimum slope setter is configurable to set the minimum slope value of the low region by determining a function represented by 1−(total level number of histogram−intermediate value of levels)/(intermediate value of levels−1)×(1−minimum slope value) if the calculated value is the same as or smaller than the intermediate value of levels, and where the minimum slope setter is configurable to set the minimum slope value of the high region by determining a function represented by 1−(1−minimum slope value)×(intermediate value of levels−1)/(total level number of histogram−intermediate value of levels) if the calculated value is larger than the intermediate value of the levels.

10. The driving apparatus of claim 9, wherein the level slope setter is configurable to set the slope for each level of the first region by determining a function represented by backlight weight×(weight for each level of first region×(1−minimum slope value of low region)+minimum slope value of low region); set the slope of the histogram level comprising the calculated value by the backlight weight; and set the slope for each level of the second region by determining a function represented by brightness weight for each level of second region×(weight for each level of second region×(1−minimum slope value of high region)+minimum slope value of high region).

11. The driving apparatus of claim 3, wherein the histogram modulator is configurable to generate the modulated brightness component by determining a function represented by slope for each level of histogram×(present histogram level−previous histogram level)+histogram number of previous level.

12. The driving apparatus of claim 2, wherein the backlight controller comprises:

a backlight controlling part configurable to generate at least one brightness control signal according to the calculated value of the histogram; and a digital/analog converter part configurable to convert the brightness control signal provided from the backlight controlling part to an analog signals.

13. The driving apparatus of claim 2, wherein the backlight comprises at least one lamp that provides a light to at least one region formed by dividing the LCD panel into regions.

14. The driving apparatus of claim 13, wherein the backlight controller is configurable to generate at least one brightness control signal that generates the light in proportion to a region brightness of the LCD panel, and supply the generated brightness control signal to the inverter.

15. The driving apparatus of claim 1, wherein the calculated value of the histogram comprises an average value of the histogram.

16. The driving apparatus of claim 1, wherein the calculated value of the histogram comprises a median value of the histogram.

17. A driving apparatus of an LCD device, having an LCD panel, a data driver, a gate driver, and a backlight that provides a light to the LCD panel, comprising:

a picture quality improving unit that is configurable to:

generate a histogram representing brightness components of input first data by levels;

generate second data comprising an extended contrast ratio related to a brightness of the histogram by levels using a backlight weight input from an external source, and the brightness of histogram by levels; and generate at least one brightness control signal according to a calculated value of the histogram;

a timing controller that supplies the second data, and controls the data driver and the gate driver; and an inverter that drives the backlight based on the brightness control signal.

18. The driving apparatus of claim 17, wherein the picture quality improving unit comprises:

a data modulator configurable to generate the second data using the first data;

a backlight controller configurable to generate at least one brightness control signal under control of the data modulation means; and a control unit configurable to receive a first synchronization signal from an external source, modulating the first synchronization signal in synchronization with the second data, and supplying the modulated first synchronization signal to the timing controller.

19. The driving apparatus of claim 18, wherein the data modulator comprises:

a brightness/color divider configurable to divide the first data into brightness components and color-difference components;

a histogram analyzer configurable to generate the histogram by dividing the brightness component of the first data by levels and analyzing a histogram number and a slope for each level of the histogram based on a calculated value of the histogram;

a histogram modulator configurable to generate modulated brightness components of extended contrast ratio by using the histogram number and slope for each level of the histogram;

a delay unit configurable to generate delayed color-difference components by delaying the color-difference components the modulated brightness component is generated in the histogram modulator; and a brightness/color mixer configurable to generate the second data by mixing the modulated brightness component and the delayed color-difference component.

20. The driving apparatus of claim 19, wherein the histogram analyzer comprises:

a histogram generator configurable to generate the histogram by dividing the brightness component of the first data into levels;

a calculator configurable to generate the calculated value by cumulating the histogram;

a backlight gain controller configurable to generate a backlight gain value using the calculated value, a backlight weight, and a total level number of the histogram;

a frequency generator configurable to generate a cumulated histogram number of a first region which is smaller than the calculated value, a cumulated histogram number of a second region which is larger than the calculated value, and a histogram number for the level of the histogram, by using the histogram and the calculated value;

a level weight setter configurable to set a brightness weight for a level of the second region by using the backlight gain value, the cumulated histogram number of the first region, the cumulated histogram number of the second region, the calculated value, and the histogram number for the level; and a level slope setter configurable to set a slope for the level of the histogram by using a minimum slope value inputted from the external source, the backlight gain value, the weight for each level of the first and second regions, and the brightness weight for each level of the second region.

21. The driving apparatus of claim 20, wherein the backlight gain controller is configurable to generate the backlight gain value by determining a function represented by (−((backlight weight−1)/total level number of histogram)× calculated value+backlight weight).

22. The driving apparatus of claim 20, wherein the level weight setter is configurable to set the weight for a level of the first region by determining a function represented by ((calculated value−1)×(histogram number for each level/cumulated histogram number of first region)); set the weight for a level of the second region by determining a function represented by ((adjacent histogram level−calculated value)×(histogram number for each level/cumulated histogram number of second region)); and set the brightness weight for the level of the second region by determining a function represented by ((adjacent histogram level−backlight weight×calculated value)/(adjacent histogram level−calculated value)).

23. The driving apparatus of claim 20, wherein the level slope setter is configurable to set a slope for a level of the first region by determining a function represented by (backlight gain value×(weight for each level of first region×(1−minimum slope value)+minimum slope value)); set a slope of the histogram level comprising the calculated value by the backlight gain value, and set the slope for the level of the second region by determining a function represented by (brightness weight for each level of second region×(weight for each level of second region×(1−minimum slope value)+minimum slope value)).

24. The driving apparatus of claim 19, wherein the histogram analyzer comprises:

a histogram generator configurable to generate the histogram by dividing the brightness component of the first data into levels;

a calculator configurable to generate the calculated value by cumulating the histogram;

a backlight gain controller configurable to generate a backlight gain value using the calculated value, a backlight weight, and a total level number of the histogram;

a frequency generator configurable to generate a cumulated histogram number of a first region which is smaller than the calculated value, a cumulated histogram number of a second region which is larger than the calculated value, and a histogram number for each level of the histogram, by using the histogram and the calculated value;

a level weight setter configurable to set a brightness weight for each level of the second region by using the backlight gain value, the cumulated histogram number of the first region, the cumulated histogram number of the second region, the calculated value, and the histogram number for each level;

a minimum slope setter configurable to set a minimum slope value of a low region if the calculated value of histogram is lower than an intermediate value of the levels, or a minimum slope value of a high region if the calculated value is higher than the intermediate value by using a minimum slope value input from the external source, the calculated value, the level number of the histogram, the intermediate value of the entire level number of the histogram; and a level slope setter configurable to set a slope for each level of the histogram by using the minimum slope values of the low and high regions, the backlight gain value, the weight for each level of the first and second regions, and the brightness weight for each level of the second region.

25. The driving apparatus of claim 24, wherein the backlight gain controller is configurable to generate the backlight gain value by determining a function represented by (−((backlight weight−1)/total level number of histogram)× calculated value+backlight weight).

26. The driving apparatus of claim 24, wherein the level weight setter is configurable to set the weight for a level of the first region by ((calculated value−1)×(histogram number for each level/cumulated histogram number of first region)); set the weight for each level of the second region by determining a function represented by ((adjacent histogram level−calculated value)×(histogram number for each level/cumulated histogram number of second region)); and set the brightness weight for each level of the second region by determining a function represented by ((adjacent histogram level−backlight gain value×calculated value)/(adjacent histogram level−calculated value)).

27. The driving apparatus of claim 24, wherein the minimum slope setter is configurable to set the minimum slope value of the low region by determining a function represented by (1−(total level number of histogram−intermediate value of the levels)/(intermediate value of the levels−1)×(1−minimum slope value)) if the calculated value is the same as or smaller than the intermediate value of the levels, and the minimum slope seller means is configurable to set the minimum slope value of the high region by (1−(1−minimum slope value)× (intermediate value of the levels−1)/(total level number of histogram−intermediate value of the levels)) if the calculated value is larger than the intermediate value of the levels.

28. The driving apparatus of claim 27, wherein the level slope setter is configurable to set the slope for each level of the first region by determining a function represented by (backlight gain value×(weight for each level of first region×(1−minimum slope value of low region)+minimum slope value of low region)); set the slope of the histogram level comprising the calculated value by the backlight gain value; and set the slope for each level of the second region by determining a function represented by (brightness weight for each level of second region×(weight for each level of second region×(1−minimum slope value of high region)+minimum slope value of high region)).

29. The driving apparatus of claim 19, wherein the histogram modulator is configurable to generate the modulated brightness component by determining a function represented by (slope for each level of histogram×(present histogram level−previous histogram level)+histogram number of previous level).

30. The driving apparatus of claim 18, wherein the backlight controller comprises:

a backlight controlling part configurable to generate at least one brightness control signal according to the calculated value of the histogram; and a digital/analog converter part configurable to convert the brightness control signal provided from the backlight controlling unit to an analog signals.

31. The driving apparatus of claim 18, wherein the backlight comprises at least one lamp that provides a light to at least one region formed by dividing the LCD panel into regions.

32. The driving apparatus of claim 31, wherein the backlight controller is configurable to generate at least one brightness control signal that generates the light in proportion to a region brightness of the LCD panel, and supply the generated brightness control signal to the inverter.

33. The driving apparatus of claim 15, wherein the calculated value of the histogram comprises an average value of the histogram.

34. The driving apparatus of claim 15, wherein the calculated value of the histogram comprises a median value of the histogram.

35. A driving method of an LCD device having an LCD panel that displays an image corresponding to a data signal, a data driver that supplies the data signal to the LCD panel, and a gate driver that supplies a scan signal to the LCD panel, comprising:

generating a histogram by dividing brightness components of input first data into levels, and generating second data having an extended contrast ratio related to a brightness of the histogram by levels using a calculated value of the histogram;

arranging the second data; and supplying the arranged second data to the data driver.

36. The driving method of claim 35, further comprising:

generating at least one brightness control signal based on the calculated value of the histogram; and providing a light to the LCD panel based on the brightness control signal.

37. The driving method of claim 36, providing the light to the LCD panel comprises:

generating a lamp driving voltage according to the brightness control signal; and driving at least one lamp to emit the light to the LCD panel divided into at least one region with the lamp driving voltage.

38. The driving method of claim 37, generating at least one brightness control signal comprises generating at least one brightness control signal to generate the light in proportion to the region brightness of the LCD panel.

39. The driving method of claim 35, wherein generating the second data comprises:

dividing the first data into brightness components and color-difference components;

analyzing a histogram number and setting a slope for a level of the histogram with the calculated value of the histogram;

generating modulated brightness components of extended contrast ratio by using the histogram number and slope for the level of the histogram;

generating delayed color-difference components by delaying the color-difference components until generating the modulated brightness component; and generating the second data by mixing the modulated brightness component and the delayed color-difference component.

40. The driving method of claim 39, wherein setting the histogram number and slope for the level of the histogram comprises:

generating the histogram by dividing the brightness component of the first data into levels;

generating the calculated value by cumulating the histogram;

generating a cumulated histogram number of a first region which is smaller than the calculated value, a cumulated histogram number of a second region which is larger than the calculated value, and a histogram number for the level of the histogram, by using the histogram and the calculated value;

setting a weight for a level of the first region and the second region, and a brightness weight for the level of the second region, by using a backlight weight supplied from the external source, the cumulated histogram number of the first region, the cumulated histogram number of the second region, the calculated value, and the histogram number; and setting a slope for the level of the histogram by using a minimum slope value supplied from the external source, the backlight weight, the weight for the level of the first region and the second region, and the brightness weight for the level of the second region.

41. The driving method of claim 40, wherein setting the weight for each level of the first region and the second region and the brightness weight for each level of the second region comprises:

setting the weight for each level of the first region by determining a function represented by (calculated value−1)×(histogram number for each level/cumulated histogram number of first region);

setting the weight for the level of the second region by determining a function represented by (adjacent histogram level−calculated value)×(histogram number for each level/cumulated histogram number of second region); and setting the brightness weight for the level of the second region by determining a function represented by (adjacent histogram level−backlight weight×calculated value)/(adjacent histogram level−calculated value).

42. The driving method of claim 40, setting the slope for each level of the histogram comprises:

setting the slope for the level of the first region by determining a function represented by backlight weight×(weight for each level of first region×(1−minimum slope value)+minimum slope value);

setting the slope of the histogram level comprising the average value by the backlight weight; and setting the slope for the level of the second region by determining a function represented by brightness weight for each level of second region×(weight for each level of second region×(1−minimum slope value)+minimum slope value).

43. The driving method of claim 39, setting the histogram number and slope for each level comprises:

generating the histogram by dividing the brightness component of the first data into levels;

generating the calculated value by cumulating the histogram;

generating a cumulated histogram number of a first region which is smaller than the calculated value, a cumulated histogram number of a second region which is larger than the calculated value, and a histogram number for the level of the histogram, by using the histogram and the calculated value;

setting a weight for the level of the first region and the second region, and a brightness weight for the level of the second region, by using a backlight weight supplied from the external source, the cumulated histogram number of the first region, the cumulated histogram number of the second region, the calculated value, and the histogram number;

setting a minimum slope value for a low region if the calculated value of histogram is lower than an intermediate value of the levels, and a minimum slope value for a high region if the calculated value is higher than the intermediate value by using a minimum slope value input from the external source, the calculated value, a total level number of the histogram, and the intermediate value of the levels of the histogram; and setting a slope for the level of the histogram using the minimum slope values of the low and high regions, the backlight weight, the weight for each level of the first and second regions, and the brightness weight for the level of the second region.

44. The driving method of claim 43, setting the weight for the level of the first and second regions and the brightness weight for the level of the second region comprise:

setting the weight for the level of the first region by determining a function represented by (calculated value−1)×(histogram number for each level/cumulated histogram number of first region);

setting the weight for the level of the second region by determining a function represented by (adjacent histogram level−calculated value)×(histogram number for each level/cumulated histogram number of second region); and setting the brightness weight for the level of the second region by determining a function represented by (adjacent histogram level−backlight weight×calculated value)/(adjacent histogram level−calculated value).

45. The driving method of claim 43, setting the minimum slope values of the low and high regions comprises:

setting the minimum slope value of the low region by determining a function represented by (1−(total level number of histogram−intermediate value of the levels)/(intermediate value of the levels−1)×(1−minimum slope value)) if the calculated value is the same as or smaller than the intermediate value of the levels; and setting the minimum slope value of the high region by determining a function represented by (1−(1−minimum slope value)×(intermediate value of the levels−1)/(total level number of histogram−intermediate value of the levels)) if the calculated value is larger than the intermediate value of the levels.

46. The driving method of claim 45, setting the slope for the level of the histogram comprises:

setting the slope for the level of the first region by determining a function represented by (backlight weight×(weight for each level of first region×(1−minimum slope value)+minimum slope value));

setting the slope of the histogram level having the calculated value by the backlight weight; and setting the slope for the level of the second region by determining a function represented by (brightness weight for each level of second region×(weight for each level of second region×(1−minimum slope value)+minimum slope value)).

47. The driving method of claim 39, generating the modulated brightness component comprises generating the modulated brightness component by determining a function represented by (slope for each level of histogram×(present histogram level−previous histogram level)+histogram number of previous level).

48. The driving method of claim 35, wherein the calculated value of the histogram comprises an average value of the histogram.

49. The driving method of claim 35, wherein the calculated value of the histogram comprises a median value of the histogram.

50. A driving method of an LCD device comprising an LCD panel that displays an image corresponding to a data signal, a data driver that supplies the data signal to the LCD panel, and a gate driver that supplies a scan signal to the LCD panel, comprising:

generating a histogram by dividing brightness components of input first data into levels, and generating second data comprising an extended contrast ratio related to a brightness of the histogram by levels using a backlight weight input from the external source;

arranging the second data; and supplying the arranged second data to the data driver.

51. The driving method of claim 50, further comprising:

generating at least one brightness control signal based on a calculated value of the histogram; and providing the light to the LCD panel based on the brightness control signal.

52. The driving method of claim 51, providing the light to the LCD panel comprises:

generating a lamp driving voltage according to the brightness control signal; and driving at least one lamp to emit the light to the LCD panel divided into at least one region with the lamp driving voltage.

53. The driving method of claim 52, generating at least one brightness control signal comprises generating at least one brightness control signal so as to generate the light in proportion to a region brightness of the LCD panel.

54. The driving method of claim 50, generating the second data comprises:

dividing the first data into brightness components and color-difference components;

analyzing a histogram number and setting a slope for the level of the histogram with the calculated value of the histogram;

generating modulated brightness components of extended contrast ratio by using the histogram number and slope for the level of the histogram;

generating delayed color-difference components by delaying the color-difference components until finished generating the modulated brightness component; and generating the second data by mixing the modulated brightness component and the delayed color-difference component.

55. The driving method of claim 54, setting the histogram number and slope for the level comprises:

generating the histogram by dividing the brightness component of the first data into levels;

generating the calculated value by cumulating the histogram;

generating a backlight gain value using the calculated value, the backlight weight, and a total level number of the histogram;

generating a cumulated histogram number of a first region which is smaller than the calculated value, a cumulated histogram number of a second region which is larger than the calculated value, and a histogram number for the level of the histogram, by using the histogram and the calculated value;

setting a brightness weight for the level of the second region by using the backlight gain value, the cumulated histogram number of the first region, the cumulated histogram number of the second region, the calculated value, and the histogram number for the level; and setting a slope for the level of the histogram by using a minimum slope value input from the external source, the backlight gain value, the weight for the level of the first and second regions, and the brightness weight for the level of the second region.

56. The driving method of claim 55, wherein generating the backlight gain value comprises determining a function represented by (−((backlight weight−1)/total level number of histogram)×calculated value+backlight weight).

57. The driving method of claim 55, setting the weight for the level of the first region and the second region and the brightness weight for the level of the second region comprises:

setting the weight for the level of the first region by determining a function represented by ((calculated value−1)×(histogram number for each level/cumulated histogram number of first region));

setting the weight for the level of the second region by ((adjacent histogram level−calculated value)×(histogram number for each level/cumulated histogram number of second region)); and setting the brightness weight for the level of the second region by ((adjacent histogram level−backlight gain value×calculated value)/(adjacent histogram level−calculated value)).

58. The driving method of claim 55, wherein setting the slope for each level of the histogram comprises:

setting the slope for the level of the first region by determining a function represented by (backlight gain value×(weight for each level of first region×(1−minimum slope value)+minimum slope value));

setting the slope of the histogram level comprising the calculated value by the backlight gain value; and setting the slope for the level of the second region by determining a function represented by (brightness weight for each level of second region×(weight for each level of second region×(1−minimum slope value)+minimum slope value).

59. The driving method of claim 54, wherein setting the histogram number and slope for the level comprises:

generating the histogram by dividing the brightness component of the first data into levels;

generating the calculated value by cumulating the histogram;

generating a backlight gain value using the calculated value, a backlight weight, and a total level number of the histogram;

generating a cumulated histogram number of a first region which is smaller than the calculated value, a cumulated histogram number of a second region which is larger than the calculated value, and a histogram number for the level of the histogram, by using the histogram and the calculated value;

setting a brightness weight for the level of the second region by using the backlight gain value, the cumulated histogram number of the first region, the cumulated histogram number of the second region, the calculated value, and the histogram number for the level;

setting a minimum slope value of a low region if the calculated value of histogram is lower than an intermediate value of the levels, and a minimum slope value of a high region if the calculated value is higher than the intermediate value by using a minimum slope value input from the external source, the calculated value, the entire level number of the histogram, the intermediate value of the entire level number of the histogram; and setting a slope for the level of the histogram by using the minimum slope values of the low region and the high region, the backlight gain value, the weight for the level of the first region and the second region, and the brightness weight for the level of the second region.

60. The driving method of claim 59, generating the backlight gain value comprises determining a function represented by (−((backlight weight−1)/total level number of histogram)×calculated value+backlight weight).

61. The driving method of claim 59, wherein setting the weight for the level of the first region and the second region and the brightness weight for the level of the second region comprises:

setting the weight for the level of the first region by determining a function represented by ((calculated value−1)×histogram number for each level/cumulated histogram number of first region));

setting the weight for the level of the second region by determining a function represented by ((adjacent histogram level−calculated value)×(histogram number for each level/cumulated histogram number of second region)); and setting the brightness weight for the level of the second region by determining a function represented by ((adjacent histogram level−backlight gain value×calculated value)/(adjacent histogram level−calculated value)).

62. The driving method of claim 59, wherein setting the minimum slope values of the low region and the high region comprises:

setting the minimum slope value of the low region by determining a function represented by (1−(total level number of histogram−intermediate value of levels)/(intermediate value of levels−1)×(1−minimum slope value)) if the calculated value is the same as or smaller than the intermediate value of the levels; and setting the minimum slope value of the high region by determining a function represented by (1−(1−minimum slope value)×(intermediate value of levels−1)/(total level number of histogram−intermediate value of levels)) if the calculated value is larger than the intermediate value of the levels.

63. The driving method of claim 62, setting the slope for the level of the histogram comprises:

setting the slope for the level of the first region by determining a function represented by (backlight gain value×(weight for each level of first region×(1−minimum slope value of low region)+minimum slope value of low region));

setting the slope of the histogram level comprising the calculated value by the backlight gain value; and setting the slope for the level of the second region by determining a function represented by (brightness weight for each level of second region×(weight for each level of second region×(1−minimum slope value of high region)+minimum slope value of high region)).

64. The driving method of claim 54, wherein generating the modulated brightness component comprises generating the modulated brightness component by determining a function represented by (slope for each level of histogram×(present histogram level−previous histogram level)+histogram number of previous level).

65. The driving method of claim 50, wherein the calculated value of the histogram comprises an average value of the histogram.

66. The driving method of claim 50, wherein the calculated value of the histogram comprises a median value of the histogram.

* * * * *

UNITED STATES PATENT AND TRADEMARK OFFICE

CERTIFICATE OF CORRECTION

PATENT NO. : 7,609,244 B2
APPLICATION NO. : 11/415747
DATED : October 27, 2009
INVENTOR(S) : Seong Gyun Kim et al.

It is certified that error appears in the above-identified patent and that said Letters Patent is hereby corrected as shown below:

In column 22, claim 27, line 42, before "means is configurable" replace "seller" with --setter--.

Signed and Sealed this

First Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,609,244 B2
APPLICATION NO. : 11/415747
DATED : October 27, 2009
INVENTOR(S) : Seong Gyun Kim It is certified that error appears in the above-identified patent and that said Letters Patent is hereby corrected as shown below:

Title page, item (*) Notice: should read as follows: Subject to any disclaimer, the term of this patent is extended or adjusted under 35 U.S.C. 154(b) by 682 days.

Signed and Sealed this

Twenty-seventh Day of July, 2010

David J. Kappos

David J. Kappos
*Director of the United States Patent and Trademark Office*